US009421570B2

(12) United States Patent
Harada et al.

(10) Patent No.: US 9,421,570 B2
(45) Date of Patent: Aug. 23, 2016

(54) METHOD FOR FORMING FLUORIDE SPRAY COATING AND FLUORIDE SPRAY COATING COVERED MEMBER

(71) Applicant: TOCALO CO., LTD., Hyogo (JP)

(72) Inventors: Yoshio Harada, Hyogo (JP); Kenichiro Togoe, Hyogo (JP)

(73) Assignee: TOCALO CO., LTD., Hyogo (JP)

( * ) Notice: Subject to any disclaimer, the term of this patent is extended or adjusted under 35 U.S.C. 154(b) by 101 days.

(21) Appl. No.: 14/376,647

(22) PCT Filed: Oct. 26, 2012

(86) PCT No.: PCT/JP2012/077676

§ 371 (c)(1),
(2) Date: Aug. 5, 2014

(87) PCT Pub. No.: WO2013/118354

PCT Pub. Date: Aug. 15, 2013

(65) Prior Publication Data

US 2015/0017463 A1 Jan. 15, 2015

(30) Foreign Application Priority Data

Feb. 9, 2012 (JP) ..... 2012-025699
Feb. 9, 2012 (JP) ..... 2012-025700

(51) Int. Cl.
*C23C 4/04* (2006.01)
*B05D 1/02* (2006.01)
(Continued)

(52) U.S. Cl.
CPC . *B05D 1/02* (2013.01); *B05B 7/205* (2013.01); *C23C 4/02* (2013.01); *C23C 4/04* (2013.01);
(Continued)

(58) Field of Classification Search
USPC ..... 428/332, 469, 472, 698, 704; 427/190, 427/229, 446, 453
See application file for complete search history.

(56) References Cited

U.S. PATENT DOCUMENTS 8,016,948 B2 * 9/2011 Wang ..... C23C 16/4404 134/1
2006/0093888 A1 5/2006 Vyas et al.
2007/0111030 A1 5/2007 Nakano et al.

FOREIGN PATENT DOCUMENTS

CN 101030524 9/2007
CN 101095249 12/2007
(Continued)

OTHER PUBLICATIONS

Office Action issued in China Counterpart Patent Appl. No. 201280069358.9, dated Aug. 5, 2015, along with an English translation thereof.
(Continued)

*Primary Examiner* — Archene Turner
(74) *Attorney, Agent, or Firm* — Greenblum & Bernstein P.L.C.

(57) ABSTRACT

[Problem] To provide a fluoride spray coating covered member adhered with a fluoride spray coating having excellent properties on quality by suppressing a thermal decomposition reaction and an oxide reaction, and to propose a method for forming a cover by firmly adhering the coating.
[Solution] A method for forming a fluoride spray coating in an implantation structure onto a substrate surface by spraying particles of a fluoride spraying material onto a substrate surface or a pretreated substrate surface, if necessary through an undercoat layer or spray particle dotted parts of carbide cermet, at a flying velocity of particles of not less than 500 m/sec with an inert gas as a working gas for coating formation at an inert gas temperature of 600° C.-1300° C. as well as a fluoride spray coating covered member.

21 Claims, 4 Drawing Sheets

(b) Coating section

(51) Int. Cl.
*C23C 4/02* (2006.01)
*B05B 7/20* (2006.01)

(52) U.S. Cl.
CPC ..... *B05D 2350/33* (2013.01); *Y10T 428/12056* (2015.01); *Y10T 428/24372* (2015.01); *Y10T 428/24413* (2015.01)

(56) References Cited

FOREIGN PATENT DOCUMENTS

| | | |
|---|---|---|
| JP | H06-036583 | 5/1994 |
| JP | H09-069554 | 3/1997 |
| JP | H11-080925 | 3/1999 |
| JP | 11-219937 | 8/1999 |
| JP | 2000-345314 | 12/2000 |
| JP | 2001-164354 | 6/2001 |
| JP | 2001-351966 | 12/2001 |
| JP | 2002-001865 | 1/2002 |
| JP | 2002-302754 | 10/2002 |
| JP | 2004-197181 | 7/2004 |
| JP | 2005-120451 | 5/2005 |
| JP | 2005-243988 | 9/2005 |
| JP | 2005-256093 | 9/2005 |
| JP | 2005-256098 | 9/2005 |
| JP | 2005-260046 | 9/2005 |
| JP | 2006-118053 | 5/2006 |
| JP | 2007-107100 | 4/2007 |
| JP | 2007-115973 | 5/2007 |
| JP | 2007-138288 | 6/2007 |
| JP | 2007-217779 | 8/2007 |
| JP | 2007-308794 | 11/2007 |
| JP | 2008-518110 | 5/2008 |
| JP | 2008-302317 | 12/2008 |

OTHER PUBLICATIONS

International Search Report PCT/JP2012/077676 dated Nov. 27, 2012.

Written Opinion and IPRP PCT/JP2012/077676 dated Aug. 12, 2014.

Japan Office Action, mail date is Aug. 5, 2014 along with an English language translation thereof.

* cited by examiner (a)

White portion is a spray particle (b)

White portion is a spray particle (c)

Cross-sectional photograph of spray particle impinged to a substrate surface of SUS310 steel (a) Coating surface (b) Coating section

METHOD FOR FORMING FLUORIDE SPRAY COATING AND FLUORIDE SPRAY COATING COVERED MEMBER

TECHNICAL FIELD

This invention relates to a method for forming a fluoride spray coating and a fluoride spray coating covered member, and more particularly to a method for forming a fluoride spray coating having excellent corrosion resistance and plasma etching resistance onto a surface of a member for semiconductor working device and the like subjected to a plasma etching as well as a fluoride spray coating covered member obtained by performing this method.

RELATED ART

An apparatus used for semiconductor working process and liquid crystal manufacturing process is required to have a cleanliness of working environment upon request for the improvement of working accuracy associated with a high integration of circuits formed on a substrate. Moreover, since a strong corrosive gas or solution such as fluoride and chloride is used in the working environment, the members and so on used in the above apparatus are violent in the corrosion loss and also secondary environment pollution of a corrosion product is not negligible.

The manufacturing and working process of the semiconductor device belongs to a so-called dry process in which a compound semiconductor made of Si, Ga, As, P and so on is mainly used and treated in vacuum or in an atmosphere under a reduced pressure. In such a dry process, treatments such as film formation, impurity implantation, etching, ashing, cleaning and the like are repeatedly performed under the above environment. As an apparatus and a member used in the dry process are included an oxidation furnace, CVD apparatus, PVD apparatus, an epitaxial growing apparatus, an ion implantation apparatus, a diffusion furnace, a reactive ion etching apparatus and members and parts accompanied with these apparatuses such as pipes, intake and exhaust fans, vacuum pump, valves and the like. In addition, it is known that these apparatuses are contacted with fluorides such as $BF_3$, $PF_3$, $PF_6$, $NF_3$, $WF_3$, HF and the like, chlorides such as $BCl_3$, $PCl_3$, $PCl_5$, $POCl_3$, $AsCl_3$, $SnCl_4$, $TiCl_4$, $SiH_2Cl_2$, $SiCl_4$, HCl, $Cl_2$, and the like, bromides such as HBr and the like, and strong corrosive reagents and gases such as $NH_3$, $CH_3F$ and the like.

In the dry process using the halide, plasma (low-temperature plasma) is frequently used for the activation of reaction and the improvement of working accuracy. Under an environment using such a plasma, the halide is converted into strong corrosive atomic or ionized F, Cl, Br and I, which provide a large effect to microfabrication of a semiconductor material. On the other hand, there is a problem that fine particles of $SiO_2$, $Si_3N_4$, Si, W and the like, which are removed from the surface of the plasma-treated semiconductor material through an etching treatment, are floated in the treating environment and adhered to the surface of the device during or after the working to deteriorate the quality of the worked product.

As one of countermeasures for these problems, there is a method wherein the surface of the member for semiconductor manufacturing and working apparatus is subjected to a surface treatment with an anode oxide of aluminum (alumite). And also, there is known a technique wherein an oxide such as $Al_2O_3$, $Al_2O_3/Ti_2O_3$, $Y_2O_3$ or an oxide of Group IIIa metal in the Periodic Table is applied onto the surface of the member by a spraying method or an evaporation method (CVD method, PVD method), or utilized as a sintered body (Patent Documents 1-5).

In recent, there is known a technique wherein the resistance to plasma erosion is improved by irradiating a laser beam or an electron beam onto a surface of $Y_2O_3$ or $Y_2O_3$—$Al_2O_3$ spray coating to remelt the surface of the spray coating (Patent Documents 6-9).

Also, there is a proposal that a fluoride coating of a metal element belonging to a halogen compound is used as a corrosion-resistant coating of the member for semiconductor working apparatus. For example, Patent Document 10 discloses a method of applying a fluoride of a rare-earth element or an alkaline earth element to a surface of a ceramic sintered body such as silicon nitride, silicon carbide or the like by a magnetron sputtering method, CVD method, a spraying method or the like. Further, Patent Document 11 discloses a member in which $YF_3$ coating is formed on $Al_2O_3$ substrate.

Moreover, Patent Document 12 discloses a method of manufacturing a susceptor by using powder consisting mainly of a fluoride of Y and lanthanoid, and Patent Documents 13 and 14 disclose a technique in which fluoride particles of Group IIIa element in the Periodic Table are formed into a coating with a spraying heat source such as inert gas plasma or combustion gas flame and then converted into a stable orthorhombic crystal by subjecting to a heat treatment at 200° C.-250° C.

Further, Patent Document 15 proposes spraying particles granulated from primary particles of Y-containing rare-earth element mixture (oxide, fluoride, chloride) having an average particle size of 0.05 μm-10 μm, and Patent Document 16 discloses a technique of utilizing a cold spraying method or an aerosol deposition method in addition to a plasma spraying method with a high heat source temperature as a method of forming a fluoride spray coating.

PRIOR ART DOCUMENTS

Patent Documents

Patent Document 1: JP-A-H06-36583
Patent Document 2: JP-A-H09-69554
Patent Document 3: JP-A-2001-164354
Patent Document 4: JP-A-H11-80925
Patent Document 5: JP-A-2007-107100
Patent Document 6: JP-A-2005-256093
Patent Document 7: JP-A-2005-256098
Patent Document 8: JP-A-2006-118053
Patent Document 9: JP-A-2007-217779
Patent Document 10: JP-A-H11-80925
Patent Document 11: JP-A-2002-001865
Patent Document 12: JP-A-2001-351966
Patent Document 13: JP-A-2004-197181
Patent Document 14: JP-A-2005-243988
Patent Document 15: JP-A-2002-302754
Patent Document 16: JP-A-2007-115973
Patent Document 17: JP-A-2007-308794

SUMMARY OF THE INVENTION

Problems to be Solved by the Invention

As to the fluoride spray coating formed by the spraying method and the method for the formation of the coating among the above conventional techniques, the invention improves the following problems (1)-(7), and proposes a fluoride spray coating covered member having excellent corrosion resistance and plasma etching resistance and a method for forming a spray coating.

(1) If a coating formation is performed by an inert gas (Ar, He) plasma spraying method or a flame spraying method of combustion gas such as hydrocarbon gas, kerosene or the like as disclosed in Patent Document 12, the following phenomenon occurs. That is, in the spraying method using plasma as a heat source, since fluoride particles flying in a high-temperature jet flame are exposed to a high-temperature environment of 5000° C.-7000° C. and a high-temperature atmosphere of 2000° C.-2800° C. is constituted even in the combustion flame, a part of the fluoride particles induces pyrolysis reaction and oxidation reaction in any heat source to discharge $F_2$ gas.

The composition of the fluoride particles is changed associated with the discharge of $F_2$ gas and hence the resulting fluoride coating is varied stoichiometrically. For example, it is presumed that when $YF_3$ particles are used for plasma spraying, they are changed into a fluoride represented by $YF_{3-x}$, because $F_2$ gas is discharged in the heat source.

However, the halogen resistance of the yttrium fluoride spray coating represented by $YF_{3-x}$, is presumed to be chemically unstable as compared to that of the fluoride particles ($YF_3$) for the coating formation. This can be known from the description of (0010) paragraph in Patent Document 13 about the yttrium fluoride coating that "It has been found that the color of yttrium fluoride coating is changed by a corrosive halogen gas in only the use of yttrium fluoride. Also, it has been found that the corrosion resistance is insufficient in only the use of yttrium fluoride and the yttrium fluoride coating is gradually lost.".

(2) Patent Document 13 proposes a technique that amorphous fluoride spray coating just after the coating formation is changed into a rhombic crystal by subjecting to a heat treatment at a temperature of 200° C.-500° C. as a countermeasure for the color change of the coating and the deterioration of the corrosion resistance. However, this technique comes to a level that the color change of the coating becomes small as described in (0014) paragraph and is not a drastic measure.

(3) Patent Document 16 discloses that the method for forming a fluoride coating is desirable to be a cold spraying method, aerosol deposition method or the like. On the other hand, when it is applied as the spraying method, there is a description that "If plasma gas of argon or helium is further mixed with hydrogen gas, the plasma temperature is increased and it is possible to form a more dense coating". However, the cold spraying method is a method wherein an inert gas of Ar, $N_2$, He or the like is heated to 500° C. and blown onto the coating-forming particles at a high rate of 300-1200 m/s according to the description edited by Japanese Thermal Spraying Society, Thermal Spraying Technology, vol. 26, No. 2/3, published on 31 Jan. 2007, pp 18~25, "Brief of Cold Spray and Research/Development Trend thereof".

In this method, there is an explanation that the gas of 500° C. is dropped to room temperature by adiabatic expansion phenomenon in the blowing part of the nozzle, and the method is not said to be suitable for the formation of fluoride coating under this condition.

In Patent Document 16, there is not a specific explanation about the cold spraying method of fluoride. That is, in this document is recommended a method for forming a fluoride coating wherein coating-formation is performed by incorporating H, gas into the inert gas such as Ar, He or the like for more raising the temperature of plasma heat source in the plasma spraying method. This is contradicted technically to the coating formation method at a low gas temperature by the cold spraying method, and its explanation is not reasonable.

(4) In the method of subjecting the fluoride spray coating to the heat treatment as described in Patent Documents 13 and 16, there is a problem that not only the number of production steps is increased but also the production efficiency is lowered and the cost is increased, and also there is a problem that the corrosion resistance of the coating is not sufficiently recovered even in the heat treatment.

(5) In the process of forming the fluoride spray coating by atmospheric plasma spraying method or high-velocity flame spraying method, fluoride particles for coating formation are thermally decomposed in the high-temperature heat source to discharge harmful $F_2$ gas having unusual smell to thereby deteriorate the working environment, so that there is a problem in the working safety and health.

(6) Further, the fluoride spray coating has an excellent halogen resistance, but is a drawback that the adhesion property to the substrate is poor. However, there is almost none of prior art documents disclosing the cause and countermeasure thereof. Even if there is a document, the disclosure mentions only an application of general blast process, and there is no recognition about intention of improving the adhesion property of the fluoride spray coating.

For example, Patent Document 13 and Patent Document 16 disclose only the roughening of the substrate surface with steel balls or corundum ($Al_2O_3$), and Patent Document 17 discloses only the roughening with $Al_2O_3$.

(7) Further, each of the above Patent Documents adopts a method of directly forming a fluoride spray coating to a surface of a substrate and does not disclose conditions of blast treatment as a pretreatment for forming a fluoride spray coating or a need of an undercoat layer and the like, so that it is apparent that the adhesion property of the fluoride spray coating is not emphasized. Therefore, there is no review on the solution means even though there is a problem that the coating is often peeled off.

It is, therefore, an object of the invention to propose a method for forming a fluoride spray coating, which can suppress thermal decomposition and oxidation reactions by spraying in an inert gas of a relatively low temperature and to provide a fluoride spray coating covered member having excellent properties such as adhesion, corrosion resistance, plasma etching resistance and the like.

Solution for Problems

Since the general method for forming a fluoride spray coating adopts a spraying method with a high heat source temperature (≥2000° C.), there are problems that not only the chemical and physical properties of the resulting coating are decreased but also the adhesion property is worse. The invention is a technique for solving the above problems developed on the basis of a finding that a new method for forming a fluoride spray coating is advantageous from the following viewpoints.

(1) It is preferable that a fluoride for coating formation (spraying material) is thermally sprayed at a heat source temperature of about 600° C.-1300° C. using an inert gas such as Ar, $N_2$, He or the like alone or a mixture thereof.

(2) It is preferable to spray a fluoride spraying material at a high flying velocity of not less than 500 m per second. By such a high-velocity spraying, spraying particles impinge upon the substrate surface with a large kinetic energy, so that they adhere to the substrate surface at a state that at least a part of the spraying particles bites into concave portions of the substrate surface or at an implantation structure. As a result, the thus formed fluoride spray coating can strongly adhere to the roughened concave portions of the substrate or irregular portions of a film-shaped undercoat layer of a carbide cermet or by forming the implantation structure state through non-film shaped spray particle dotted parts of carbide cermet at a state of sparsely sticking a part of the particles into the substrate surface as piles. Thus, it can be attempted to improve the adhesion property of the fluoride spray coating.

(3) The surface of the substrate for covering the fluoride spray coating is preferable to be previously subjected to a blast roughening treatment with abrasive particles of $Al_2O_3$, SiC or the like together with degreasing and descaling according to operation standard for ceramic sprayed coatings defined in JIS H9302 to form irregular parts and further to be preheated.

(4) Prior to the covering of the fluoride spray coating, it is preferable to form a carbide cermet coating on the substrate surface by a high-velocity flame spraying of a carbide cermet material such as WC—Co, WC—Ni—Cr or the like according to the above method (2).

(5) The undercoat layer using the carbide cermet is preferable to be a film-shaped layer covering substantially the whole of the substrate surface evenly.

(6) The spray particle dotted parts using the carbide cermet are preferable to be a non-film shaped portion that the spraying particles of the carbide cermet are sparsely dotted at an area ratio (ratio covering the substrate surface) of 8-50%. This portion is distinguished from the film-shaped undercoat layer of carbide cermet covering the whole of the substrate surface with an approximately equal thickness.

(7) A distance between the substrate surface and the nozzle of the spray gun using a low-temperature inert gas as a driving source is maintained at 5-50 mm. Thus, it is preferable to form the fluoride spray coating having an excellent adhesion property.

The invention developed under the above findings is a method for forming a fluoride spray coating, characterized in that a fluoride spraying material is blown onto a substrate surface or a pretreated substrate surface at a flying velocity of not less than 500 m/sec in a spray gas atmosphere maintained at a temperature of 600° C.-1300° C. with a spray gun using an inert gas such as Ar, $N_2$, He or a mixed gas thereof as a working gas for coating formation to form a fluoride spray coating adhered thereon so as to provide such an implantation structure that at least a part of the fluoride spraying material bites into concave portions of the substrate surface.

Also, another method for forming a fluoride spray coating according to the invention is characterized in that a carbide cermet material is first sprayed onto a substrate surface or a pretreated substrate surface at a flying velocity of 150-600 m/sec, preferably 300-600 m/sec to form a film-shaped undercoat layer, and then a fluoride spraying material is blown onto the undercoat layer at a flying velocity of not less than 500 m/sec in a spray gas atmosphere maintained at a temperature of 600° C.-1300° C. with a spray gun using an inert gas such as Ar, $N_2$, He or a mixed gas thereof as a working gas for coating formation to form a fluoride spray coating adhered thereon so as to provide such an implantation structure that at least a part of the fluoride spraying material bites into concave portions of the undercoat layer.

In order to form the film-shaped undercoat layer on the substrate surface, abrasive particles such as $Al_2O_3$, SiC or the like are previously blown onto substrate surface to form a roughened surface, and thereafter carbide cermet particles such as WC—Co, $Cr_3C_2$—Ni—Cr or the like are blown to the roughened surface at a spraying number (repetition number of movement) of 6 times or more with a commercially available high-velocity flame apparatus operated at a usual gun moving rate under controlled conditions that an amount supplied to a spray gun is 100-200 g/min and a moving rate when the spray gun is repeatedly moved on the substrate surface is 300-1000 mm/sec so as to provide an approximately uniform thickness of 30-200 μm.

Further, a still another method for forming a fluoride spray coating according to the invention is characterized in that after the substrate surface or the pretreated substrate surface is roughened with abrasives, a carbide cermet particles are first sprayed at a flying velocity of 150-600 m/sec, preferably 300-600 m/sec to form spray particle dotted parts of carbide cermet at an area ratio of 8-50% and at a state of sparsely skewing tip portions of at least a part of the carbide cermet spraying particles as piles and then a fluoride spraying material is blown through the spray particle dotted parts at a flying velocity of not less than 500 m/sec in a spray gas atmosphere maintained at a temperature of 600° C.-1300° C. with a spray gun using an inert gas such as Ar, $N_2$, He or a mixed gas thereof as a working gas for coating formation to form a fluoride spray coating adhered thereon so that the fluoride spraying material bites into gaps between the particles in the spray particle dotted parts.

In order to form the non-film shaped spray particle dotted parts of carbide cermet on the substrate surface, after the roughening treatment of the substrate surface with the abrasive particles, carbide cermet particles of WC—Co, $Cr_3C_2$—Ni—Cr or the like are sprayed with a commercially available high-velocity flame spraying apparatus (gun) under controlled conditions that an amount supplied to the spray gun is 100-200 g/min and a moving rate when the spray gun is repeatedly moved on the substrate surface is 300-1000 mm/sec at a spraying number (moving number) of not more than 5 times, preferably not more than 3 times by the same operation as in the formation of the undercoat layer, whereby the spray particle dotted parts of carbide cermet can be made at an area ratio of 8-50%.

Moreover, the invention proposes a fluoride spray coating covered member comprising a substrate and a fluoride spray coating formed on the surface of the substrate, characterized in that the fluoride spray coating has an implantation structure that at least a part of fluoride spraying particles bites into the substrate surface directly or bites into a surface of an undercoat layer of carbide cermet or a spray particle dotted part of carbide cermet formed on the substrate surface at a state of sticking into concave portions of the surface or between dotted particles or of skewing tip portions of the hard carbide cermet into the substrate.

Further, another fluoride spray coating covered member according to the invention is a fluoride spray coating covered member comprising a substrate and a fluoride spray coating formed on the surface of the substrate, characterized that a film-shaped undercoat layer of carbide cermet formed by spraying carbide cermet spraying particles such as WC—Co, WC—Ni—Cr, WC—Co—Cr or $Cr_3C_2$—Ni—Cr is existent between the substrate and the fluoride spray coating.

Furthermore, a still another fluoride spray coating covered member according to the invention is a fluoride spray coating covered member comprising a substrate and a fluoride spray coating formed on the surface of the substrate, characterized in that a non-film shaped spray particle dotted part of carbide cermet spraying particles made of WC—Co, WC—Ni—Cr, WC—Co—Cr or $Cr_3C_2$—Ni—Cr and adhered at an area ratio of 8-50% is existent between the substrate and the fluoride spray coating at such a state that at least a part of the carbide cermet spraying particles bites into the substrate surface and sparsely stuck and forested as piles.

The invention is preferable to have further the following constructions.

(1) The pretreatment is a descaling, a degreasing, a roughening and a preheating, i.e. a treatment of heating the substrate to a temperature of 80-700° C.;

(2) The roughening is a treatment of blowing abrasives of $Al_2O_3$, SiC or the like to the substrate surface to make a surface roughness to Ra: about 0.05-0.74 μm and Rz: 0.09-2.0 μm;

(3) The substrate is any of Al and its alloy, Ti and its alloy, carbon-containing iron steel, various stainless steels, Ni and its alloy, oxides, nitrides, carbides, silicides and carbon sintered body;

(4) The fluoride spray coating is formed by blowing fluoride particles having a particle size of 5 μm-80 μm made of one or more selected from fluorides of Mg in Group IIa of the Periodic Table, Al in Group IIIb of the Periodic Table, Y in Group IIa of the Periodic Table, and lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu) as a lanthanoid series metal in Atomic Numbers 57-71 of the Periodic Table onto the substrate surface at a thickness of 20 μm-500 μm;

(5) The carbide cermet is at least one selected from WC—Co, WC—Ni—Cr, WC—Co—Cr, $Cr_3C_2$—Ni—Cr and the like;

(6) In the spraying method using the inert gas as a working gas for coating formation, a distance between the substrate surface and a nozzle tip of the spray gun in the spraying of fluoride particles is maintained to a distance of 5-50 mm;

(7) The flying velocity of the spraying particles is not less than 600 m/sec but not more than 800 m/sec;

(8) The flying velocity of the spraying particles is not less than 650 m/sec but not more than 1000 m/sec;

(9) The temperatures of the working gas and the spraying atmosphere are not lower than 700° C. but not higher than 1300° C.

Effect of the Invention

According to the invention having the constructions mentioned above, the following effects can be expected.

(1) Since the inert gas such as Ar, $N_2$, He or the like is used as a spraying heat source for heating the fluoride spraying material for coating formation, fluoride particles flying in the spraying heat source are reached to a surface to be coated without oxidation and modification to form a spray coating. Therefore, since the spraying is performed under non-oxidizing atmosphere, oxidation reaction is suppressed and a stable quality is obtained without damaging performances inherent to the fluoride.

(2) Since the temperature of the spraying heat source of the inert gas for heating fluoride particles is a lower temperature of 600° C.-1300° C. as compared with a heat source temperature of a general plasma spraying method of 5000° C.-7000° C. and a heat source temperature of a high-velocity flame spraying method of 1800° C.-2800° C., the spray coating can be formed while suppressing a thermal decomposition reaction of fluoride particles so as not to cause a change of chemical mass and deterioration of physical-chemical properties associated therewith.

(3) Since the velocity of fluoride particles flying in the inert gas is set to not less than 500 m/sec, a temperature exposed time of the particles becomes short (1/1000 second) to further enhance the above effects (1) and (2). By the increase of collision energy to the substrate surface obtained by applying a large kinetic energy to the fluoride particles are buried tip portions of the flied spraying particles so as to bite into a surface to be coated, particularly concave portions thereof. In addition, when the undercoat layer or spray particle dotted parts of carbide cermet is present, the adhesiveness of the spray coating can be improved by biting the particles into a gap between the dotted parts or adhering tip portions of the stuck carbide cermet at a skewed state.

(4) In case of adjusting the above-mentioned conditions such as low temperature, inert gas heat source, high-velocity flying particles and the like, it is possible to make easy the coating formation of high vaporizable fluoride particles (for example, $AlF_3$) or the like at a high temperature, which has not been attained in the current plasma spraying method or the like.

(5) In addition to the above conditions of the spraying method, the surface of the substrate for forming the spray coating is first subjected to a roughening through blasting or a pretreatment of preheating the substrate to 80° C.-700° C. and thereafter the undercoat layer or spray particle dotted part of carbide cermet is formed, so that the adhesion (adhesiveness) of fluoride spraying particles can be improved.

(6) When the substrate is roughened by the pretreatment (Ra: about 0.1-0.85 μm, Rz: about 0.10-2.0 μm), at least a part of the fluoride spraying particles blown onto the undercoat layer or spray particle dotted parts of hard carbide cermet such as WC—Ni—Cr, $Cr_3C_2$—Ni—Cr or the like, which is formed to the substrate surface by a high-velocity flame spraying method, takes an implantation structure having an anchor action (action of mechanically biting the particles into the roughened substrate surface (concave and convex faces) to improve the adhesion between the fluoride spray coating and the substrate) or a phenomenon causing the skewed state, which brings about the improvement of an attaching deposition ratio of the fluoride spraying material particles as a topcoat and the improvement of the adhesion.

(7) Since the fluoride is small in the surface energy, the mutual bonding force of the fluoride particles constructing the coating and the adhesion to the substrate are low and there is a drawback that the coating is often peeled off. In this regard, according to the invention, the fluoride as a topcoat and the undercoat carbide cermet (carbon is a main ingredient) are strong in the mutual chemical affinity and have a well wetting property to each other, so that the adhesion of the coating is improved by synergistically acting the chemical affinity in addition to the physical attaching action of fluoride particles through the above roughening.

(8) Since the surface of the substrate is at a state of sticking and burying a part of carbide cermet particles, the strength of the substrate surface is increased.

EMBODIMENTS FOR CARRYING OUT THE INVENTION

Figure 1:
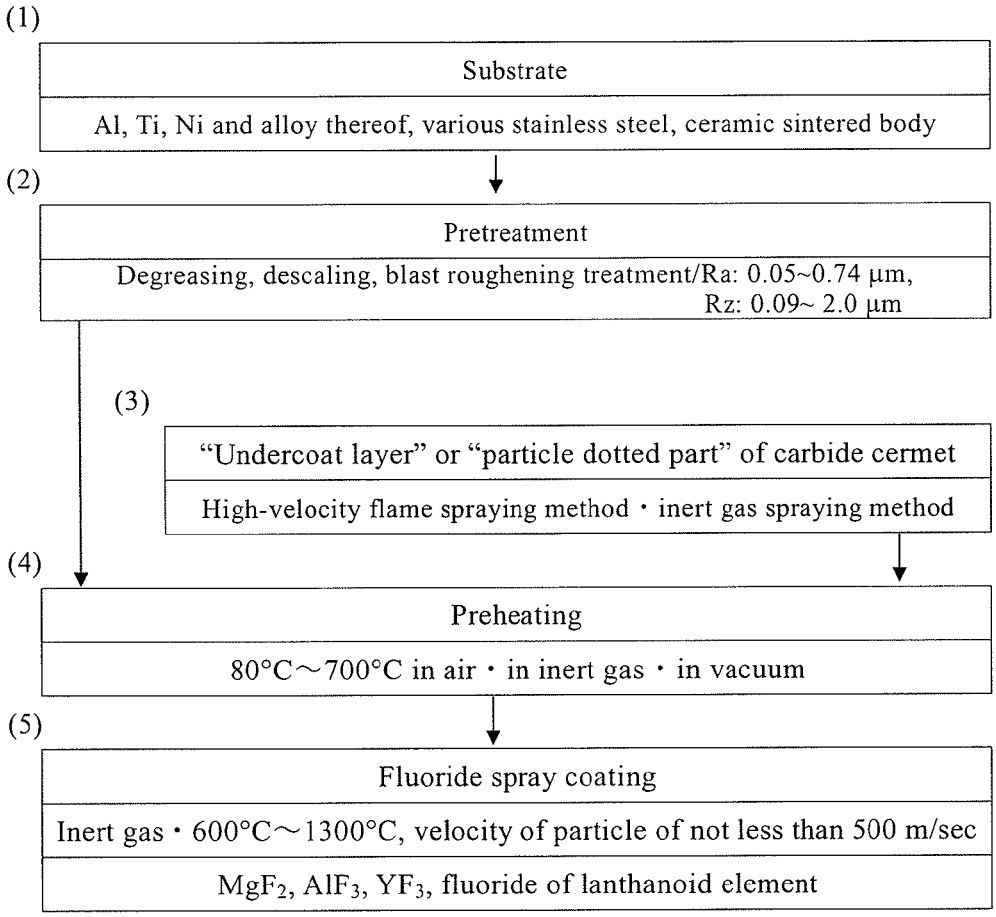
FIG. 1 is a flow chart showing process sequence for carrying out the method according to the invention.

An embodiment of the invention will be described with reference to the accompanying drawings below. FIG. 1 is a flow chart showing process sequence for carrying out the method according to the invention. Hereinafter, the invention will be explained according to this process sequence.

(1) Substrate

The substrate usable in the invention is Al and its alloy, Ti and its alloy, various alloy steels inclusive of stainless steel, carbon steel, Ni and its alloy and so on. In addition, a ceramic sintered body of oxide, nitride, carbide, silicide and the like and a sintered carbon material can be used.

(2) Pretreatment

The surface of the substrate is preferable to be treated according to operation standard of ceramic sprayed coatings defined in JIS H9302. For example, the surface of the substrate is degreased or descaled and thereafter subjected to a roughening (blast treatment) by blowing abrasive particles of $Al_2O_3$, SiC or the like to form an irregular surface state easily adhering fluoride particles and the like. The surface roughness of the substrate after the roughening is preferable to be Ra: 0.05-0.74 μm and Rz: 0.09-2.0 μm so that the fluoride spray coating easily takes an implantation structure. More preferably, in order to more ensure the bonding property of the fluoride spray particles to an undercoat layer or particle dotted parts of carbide cermet as mentioned later, it is preferable to preheat the substrate to about 80-700° C.

(3) Formation of film-shaped undercoat layer or non-film shaped spray particle dotted parts of carbide cermet a. Film-Shaped Undercoat Layer of Carbide Cermet By spraying a carbide cermet (spraying) material having a particle size of 5-80 μm onto the roughened substrate surface after the blast treatment by the same method as a high-velocity flame spraying method or an inert gas spraying method inherent to the invention as mentioned below, tip portions of at least a part of the spraying particles is rendered into a state of sticking and burying in the substrate surface and a part of the other particles is rendered into a state of adhering and depositing onto the substrate surface to thereby form a film-shaped undercoat layer of the carbide cermet. This undercoat layer is formed at a film state by moving and spraying the carbide cermet material (particle size: 5 μm-80 μm) at a flying velocity of 150-600 m/sec, preferably 300-600 m/sec with a spray gun in a spraying number of not less than 6 times but about 10 times. When the flying velocity of the spraying particles is less than 150 m/sec, the bitten depth of the particles into the substrate surface is not sufficient and the adhesion strength is decreased. While, when it exceeds 600 m/sec, the effect is saturated in the case of using the carbide cermet particles. Moreover, when the spraying number is not more than 5 times, it is difficult to form a uniform film of the spray coating.

Figure 2:
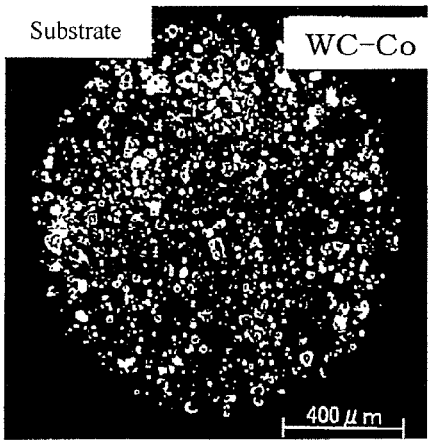
FIG. 2 is an SEM image illustrating a particle behavior at an initial stage when carbide cermet spraying particles having a composition of WC-12 mass % Co are sprayed onto a substrate surface by a high-velocity flame spraying method, wherein (a) is a view of a surface sprayed with the carbide cermet particles, and (b) is an enlarged view of the surface, and (c) is a cross sectional view of the substrate sprayed with the cermet particles.
Figure 2:
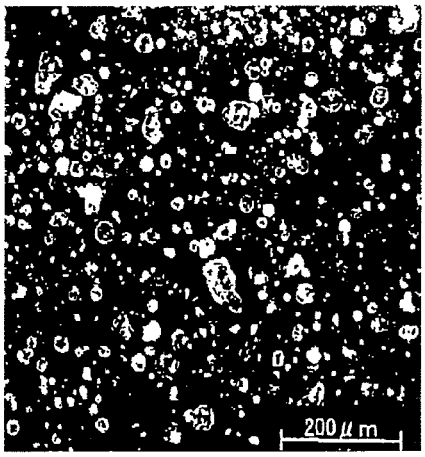
Figure 2:
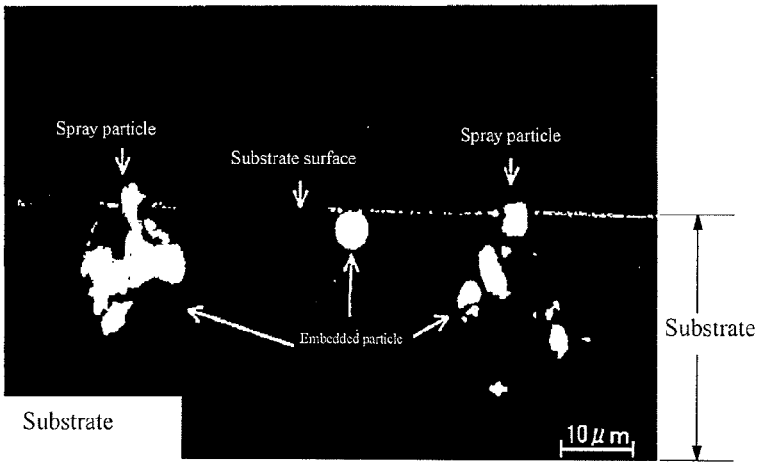

FIG. 2 shows forms of a substrate surface and a section thereof at an initial stage in the formation of an undercoat layer of carbide cermet, i.e. just after the carbide cermet particles are sprayed at a flying velocity of 550 m/sec by a high-velocity flame spraying method. FIG. 2(*b*) shows a state that a part of sprayed WC—Co cermet particles is adhered to the substrate surface so as to dig thereinto, while the other WC—Co cermet particles are scattered in the substrate at a partially crushed state by collision energy and attached thereto. FIG. 2(*c*) shows a cross-sectional state when observing a distribution condition of WC—Co cermet particles sprayed to a surface layer portion of the substrate at an initial stage before the coating formation. As seen from this photograph, tip portions of a part of WC—Co cermet particles are stuck and buried into the substrate surface at the initial stage, while the other part becomes a simply adhered or buried state. In this manner, more uniform film is obtained as the spraying number is increased.

That is, when the WC—Co spraying material is sprayed repeatedly (≥6 times) to the substrate surface adhered with WC—Co cermet spraying particles by a high-velocity flame spraying method successively, WC—Co particles are gradually deposited even onto non-adhered parts of the substrate surface (black parts of FIG. 2(*a*)) to form a film-shaped undercoat layer of WC—Co cermet particles applied over the whole surface in due course. On the contrary, in case of a general metallic undercoat of Ni—Cr, Ni—Al or the like widely used in the formation of an oxide ceramic spray coating, particles buried in the substrate as shown in FIG. 2 are not observed.

In the invention, when the undercoat layer of carbide cermet is formed in the substrate surface, the adhesion between the undercoat and the substrate is enhanced by the behavior of hard carbide cermet, while the improvement of the adhesion of the fluoride spray coating in the undercoat/topcoat (fluoride spray coating) is attained by a synergistic effect between a surface roughness and a chemical affinity (between carbon and fluoride) of the undercoat layer.

At least a part of carbide cermet spraying particles being at a state that the particles existing in a lowermost layer of the undercoat layer are stuck into the substrate surface is firmly bonded to the substrate, while a large compression strain is applied to the substrate surface, which not only gives a large resistance to mechanical deformation of the substrate but also improves the adhesion between the substrate and the undercoat layer of carbide cermet itself to improve the adhesion to the fluoride spray coating covered thereon.

In the invention, the undercoat layer of carbide cermet adhered and deposited onto the substrate surface at a state of burying a part of the spraying particles is particularly effective for the substrate being soft and susceptive to deformation or strain under a load in a use environment such as Al and its alloy, Ti and its alloy, mild steel, various stainless steels and so on, and guarantees the formation of fluoride spray coating having always a stable and high adhesion regardless of kind of substrate material That is, the fluoride coating is originally poor in the ductility and small in the surface energy and hardly joins to a metal series substrate, so that the peel-off of the coating is easily caused by the generation of a little deformation or strain of the substrate. However, it is possible to suppress external stress or strain applied to the fluoride coating by the suppression of the substrate deformability based on the burying of carbide cermet particles into the substrate surface and the formation of the undercoat layer of carbide cermet to formed thereon.

The thickness of the undercoat layer of carbide cermet formed on the substrate surface is preferable within a range of 30-200 μm particularly preferable within a range of 80-150 μm. When the thickness of the undercoat layer is less than 30

μm, the coating thickness becomes easily uneven, while when it exceeds 200 μm, the effect as the undercoat layer is saturated and is uneconomic.

b. Formation of Spray Particle Dotted Parts by Carbide Cermet

Carbide cermet particles having a particle size of 5-80 μm are sprayed onto the substrate surface roughened through blasting at a high rate by a high-velocity flame spraying method or the same method as in the following inert gas spraying method inherent to the invention, whereby tip portions of at least a part of the sprayed hard carbide cermet particles are independently skewed and stuck as piles into the substrate surface. According to this method, spray particle dotted parts of the carbide cermet particles adhered at a sparse pattern is formed to the substrate surface. In this case, if the particle size of the carbide cermet particles is less than 5 μm, the amount supplied to a spray gun becomes uneven and the uniform spraying cannot be performed and also the amount of skewed particles becomes small and it is impossible to form effective spray particle dotted parts. On the other hand, if the particle size exceeds 80 μm, the skewing effect becomes weakened.

Moreover, the spray particle dotted part is a portion that the carbide cermet material (particle size: 5-80 μm) is sprayed to the substrate surface at an area ratio of 8~50% with a spray gun at a flying velocity of 150~600 m/sec, preferably 300~600 m/sec in the spraying number of not more than 5 times, preferably not more than 3 times to adhere the sprayed particles at a state of sparsely sticking as piles.

The spray particle dotted parts of carbide cermet sparsely dispersed in this treating step are not completely film-shaped and form the following structure. That is, as seen from FIGS. 2(*a*) and (*b*) showing an appearance state when particles of WC-12 mass % Co carbide cermet material are sprayed to a surface of SUS310 steel substrate, a part of the sprayed WC—Co cermet particles is at a state of adhering to 8-50% portions of the substrate surface so as to dig thereinto. Moreover, the other WC—Co cermet particles are dispersedly adhered to the substrate surface at a state of being partially crushed by collision energy, and further a part of the other is at a state of completely burying in the substrate to form a reinforcing layer of carbide cermet in the surface layer of the spray coating.

FIG. 2(*c*) is a view observing a distribution state of the sprayed WC—Co cermet particles existing in the surface layer portion of the substrate at section. As seen from this photograph, WC—Co cermet particles are existent at a state of foresting small piles sparsely stuck in the substrate surface, and another part thereof is simply adhered or buried. In the invention, when the fluoride particles are sprayed onto the substrate surface at such a state or onto the spray particle dotted parts of the carbide cermet particles adhered at such a state (this part does not form a complete layer), the fluoride spray coating having high adhesion will be formed by utilizing a mutually entangling action (implantation structure) with hard WC—Co cermet particles stuck as piles (fluoride sprayed particles) or a skewing phenomenon.

In this invention, an area ratio (area occupying ratio) of carbide cermet particles is determined by means of an image analyzing device using SEM photograph of FIG. 2(*a*) or FIG. 2(*b*) when white parts are carbide cermet particles and black parts are an exposed surface of the substrate to the spray particle dotted parts of carbide cermet. As a result, it is confirmed that a ratio occupied by the spray particle dotted parts or an area ratio is preferable to be within a range of 8-50%. When it is less than 8%, the wedging effect of carbide cermet particles is weak, while when it exceeds 50%, the action mechanism is the same as in an undercoat layer of carbide cermet mentioned later and the wedging effect of the fluoride particles becomes small. In this invention, a state of the substrate surface in which the carbide cermet particles are sprayed at an area ratio of 8-50% is called as "spray particle dotted parts".

As the carbide cermet spraying material usable in this invention can be used WC—Co, WC—Ni—Cr, WC—Co—Cr, $Cr_3C_2$—Ni—Cr and the like. Moreover, a percentage of a metal ingredient occupied in the carbide cermet is preferably within a range of 5-40 mass %, particularly preferably within a range of 10-30 mass %. When the metal ingredient is less than 5 mass %, the hard carbide is made to small powder, and a ratio remaining on the substrate surface becomes small, while when the metal ingredient exceeds 40 mass %, the hardness and corrosion resistance are deteriorated and the entangling effect with the fluoride particles is decreased, and the substrate is liable to be corroded by a corrosive gas penetrated from through-holes of the fluoride spray coating and also the bonding force of the fluoride spray coating is vanished to induce the peeling-off.

On the other hand, the carbide cermet particles is preferable to have a particle size of 5-80 μm, particularly 10-45 μm. When the particle size is less than 5 μm, the supply to the spray gun becomes discontinuous, and the formation of uniform coating is difficult, and the particles are finely crushed and scattered in the collision with the substrate and hardly retains on the substrate surface. While, when the particle size exceeds 80 μm, the effect is saturated and it is difficult to obtain commercially available products.

(4) Preheating of Substrate

The substrate after the roughening and the substrate after the formation of the undercoat layer or spray particle dotted parts of carbite cermet are subjected to a preheating prior to the fluoride spraying treatment. The preheating temperature is preferable to be controlled in accordance with the nature of the substrate and is recommended to be the following temperature. Moreover, the preheating may be performed as one of pretreatments.

(i) Al, Ti and alloys thereof: 80° C.-250° C.

(ii) Iron steel (low alloy steel): 80° C.-250° C.

(iii) Stainless steel: 80° C.-250° C.

(iv) Ceramic sintered bodies of oxides and carbides: 120° C.-500° C.

(v) Sintered carbon: 200° C.-700° C.

Also, the preheating may be conducted in air or under vacuum or in an inert gas, but an atmosphere of oxidizing the substrate material by preheating to produce an oxide film on the surface should be avoided.

In the method according to the invention, one of the greatest reasons for preheating the substrate is due to the fact that when the inert gas is sprayed at a high rate from a nozzle, a gas temperature of, for example, about 600° C. is dropped to around 50° C. by an adiabatic expanding phenomenon of the gas to thereby cool the substrate. If the temperature of the substrate surface becomes such a low temperature, the fluoride spraying particles sprayed from the nozzle (melting point of fluoride is 1152° C. in case of $YF_3$ and 1350° C. in case of $ErF_3$) collide to the substrate surface without melting in the gas and a larger amount of the particles are flied apart to considerably lower a probability of coating-formation. Even if the coating is formed, the mutual bonding force of the fluoride particles is weak, and quality deterioration such as formation of coating having a large porosity or the like is caused.

The invention aims for improving the adhesion force of fluoride particles by the pretreatment of the substrate surface, the formation of the undercoat layer of carbide cermet on the substrate surface, and further the provision of large kinetic energy based on hot high-velocity spraying of fluoride particles to the substrate surface with an inert gas mentioned below.

(5) Formation of Fluoride Spray Coating (Topcoat)

a. Fluoride Spraying Material

As a fluoride spraying material powder used in the invention are included fluorides of Mg in Group IIa of the Periodic Table, Al in Group IIIb of the Periodic Table, Y in Group IIIa of the Periodic Table, and lanthanoid metals belonging to Atomic Number 57~71 in the Periodic Table. The metal elements of Atomic Number 57~71 are 17 sorts of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu).

As the spraying material are used fluoride particles of the above metal adjusted to a particle size of 5-80 μm. When the spraying material is fine particles having a particle size of less than 5 μm, there is a drawback that the particles are frequently flied apart without forming the coating in the collision with the substrate surface, while when the particle size exceeds 80 μm, the rate supplied to a spray gun is hardly equalized and the tendency of increasing the pore size of the formed coating becomes remarkable.

The spray coating of fluoride particles formed on the surface of the substrate or the like after the roughening or after the formation of the undercoat layer or spray particle dotted parts of carbide cermet or further after the preheating is sufficient to have a thickness of 20-500 μm, preferably 50-200 μm. When the coating is thinner than 20 μm, uniform thickness is not obtained, while when the thickness exceeds 500 μm, residual stress in the formation of the fluoride coating becomes large to bring about the decrease of the adhesion force to the substrate and the peeling is liable to be easily caused.

(b) Spraying Apparatus and Coating-Formation Method

Figure 3:
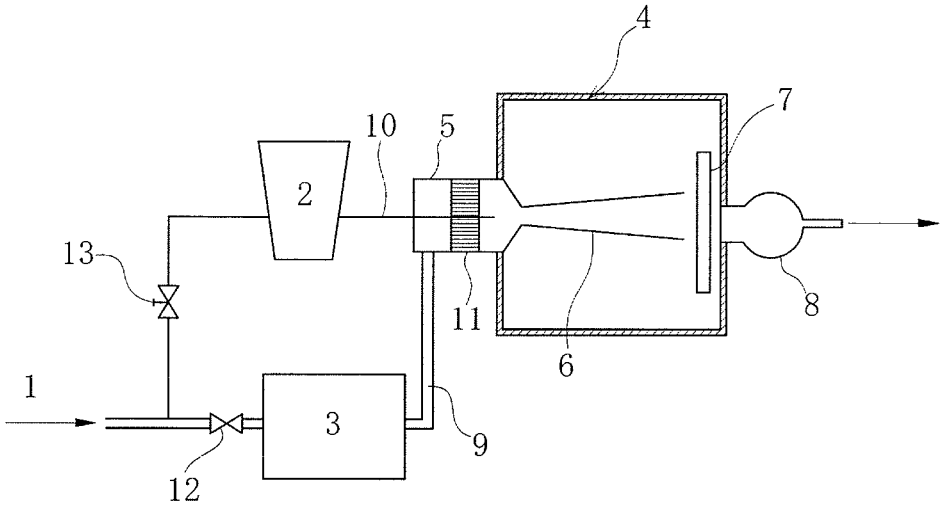
FIG. 3 is a schematic view of an apparatus for forming a low-temperature spray coating utilized in the method according to the invention.
Figure 4:
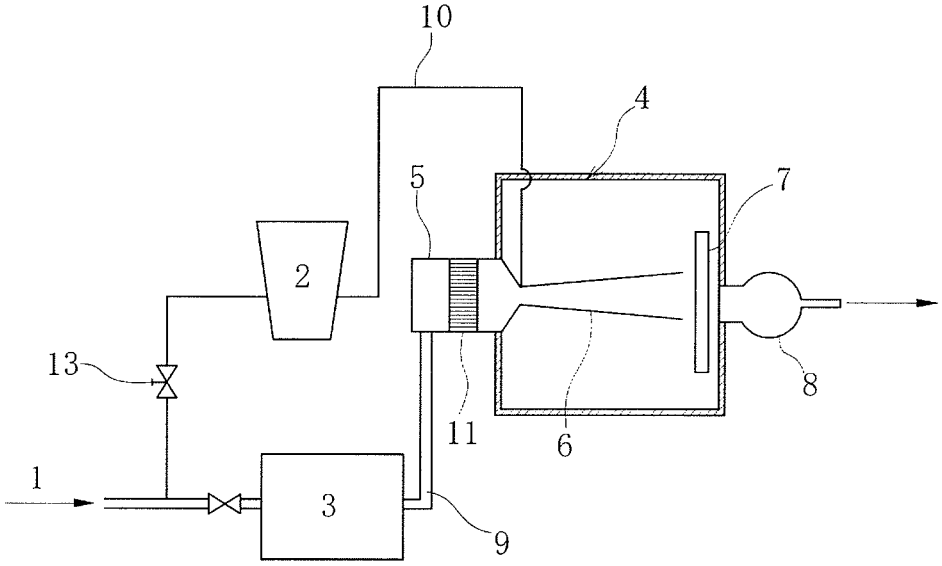
FIG. 4 is a schematic view of another apparatus for forming a low-temperature spray coating utilized in the method according to the invention.

As an apparatus used for carrying out the invention can be used an apparatus used in a low-temperature spray coating covered member and a method for manufacturing the same as disclosed in Japanese Patent No. 4628578 proposed previously by the inventors. FIG. 3 and FIG. 4 show preferable embodiments of an apparatus effective for forming the fluoride spray coating according to the invention on the substrate surface among the above proposed apparatuses. In these figures, 1 is a working gas source supplied from a compression gas bomb, 2 is a supply device of a spraying material, 3 is a heat exchanger for a gas pressurization, 4 is a spraying vessel, 5 is a spray gun, 6 is a nozzle, 7 is an object to be treated, 8 is a silencer, 9 is a main gas pipe for a working gas, 10 is a sub gas pipe for transferring powder of a spraying material, 11 is a rectifying plate for a working gas, and 12, 13 are flow rate control valves arranged in the respective gas pipes.

In these illustrated apparatuses, a high-pressure inert gas supplied from the working gas source 1 is divided into two gas flows, and one of the gas flows is transferred to the heat exchanger 3 as a working gas for coating formation and heated to 600-1300° C. and then sprayed to an object to be treated 7 through the nozzle 6 as a supersonic spraying gas. In this case, the temperature is controlled so as to prevent extreme temperature dropping associated with adiabatic expansion. A lower limit of the working gas temperature is preferably not lower than 700° C., more preferably not lower than 800° C. On the other hand, a preferable upper limit of the temperature is 1200° C.

When the working gas temperature is lower than 600° C., it is made to a low temperature around 50° C. due to adiabatic expansion phenomenon at the outlet of the spray gun and hence the effect of raising the temperature of the fluoride particles is not obtained, so that the temperature is made to not lower than 600° C. and is more effective to be 800° C. with respect to such an action. On the other hand, when the temperature exceeds 1300° C., energy required for heating the inert gas becomes larger and further a cost of countermeasures for a heat resistance of accessory equipment becomes higher. The temperature may be made to not higher than about 1200° C. for this action.

Moreover, the other divided gas flow is used as a carrier gas for a spraying powder material. This gas is joined with the above working gas in the spray gun 5 and rendered into a supersonic gas flow in the nozzle 6 (in case of FIG. 3), whereby the spraying material particles are flied at a high velocity toward the treating object and collided and sprayed thereto so as to bit at least a part of the particles into the treating surface in such a manner that the thickness is gradually increased to form a spray coating having a predetermined thickness. As shown in Fig. 4, the spraying material particles may be charged from a reduced-pressure portion in the outlet of the spray gun 5 (near to an attaching portion of the nozzle 6). In any of these cases, the distance between the nozzle 6 and the object to be treated is preferably 5-50 mm, more preferably 10-30 mm. When the distance is less than 5 mm, it is impeditive to the gas flow, while when it exceeds 50 mm, an adhesion ratio of the fluoride particles is decreased remarkably.

The fluoride spraying material particles are sprayed to the treating object 7 at a flying velocity of not less than 500 m/sec from the nozzle 6 of the spray gun 5 together with the inert gas as a working gas for coating formation. The reason why the flying velocity is set to not less than 500 m/sec is due to the fact that if it is less than 500 m/sec, the adhesion ratio of the fluoride particles to the substrate surface is decreased extremely. Moreover, a lower limit of the velocity is preferably 600 m/sec, more preferably 650 m/sec. On the other hand, an upper limit of the flying velocity is restricted by the performance of the spraying apparatus members, but is preferable to be not more than 800 m/sec, more preferably about 750 m/sec.

Moreover, a portion for generating a supersonic gas (nozzle 6) and the object to be treated 7 are protected by the spraying vessel 7 made of steel. Further, it is configured that a sound of shock wave generated by the supersonic gas is not leaked to an external with the action of the silencer 8.

A feature of the invention lies in that an inert gas such as a gas of Ar, $N_2$ or He alone or a mixed gas thereof is used as a high-pressure working gas. Also, a pressure of these gases is preferable to be controlled to not less than 0.5 MPa but less than 1.0 MPa. In the invention, the reason why the inert gas as explained above is focused as the working gas is due to the fact that even if it is heated to a high temperature of 1300° C., various metal members constructing the spraying apparatus are not consumed by oxidation and also a physicochemical change by the oxidation reaction can be made minimum even when the fluoride particles are heated. Further, the reason why the pressure is limited to not less than 0.5 MPa but less than 1.0 MPa is due to the fact that it is suitable to utilize kinetic energy of an inert gas for heat source. When a gas having a pressure of not less than 1 MPa is used, there is no problem in the coating formation, but it is necessary to take a legal measure on a high-pressure gas management and is not favorable in the safety of working.

Although the above is explained on the method for forming a fluoride spray coating with reference to the apparatuses used in a low-temperature thermal spraying method disclosed in Japanese Patent No. 4628578 proposed previously by the inventors, a similar low-temperature spraying apparatus (cold spray) having excellent workability and economic efficiency may be used. In the invention, therefore, any apparatuses satisfying coating-forming conditions of the fluoride spray coating, specifically, kind, temperature, flow rate and the like of the working gas can be used, so that the spraying apparatus is not limited to the above examples.

Figure 5:
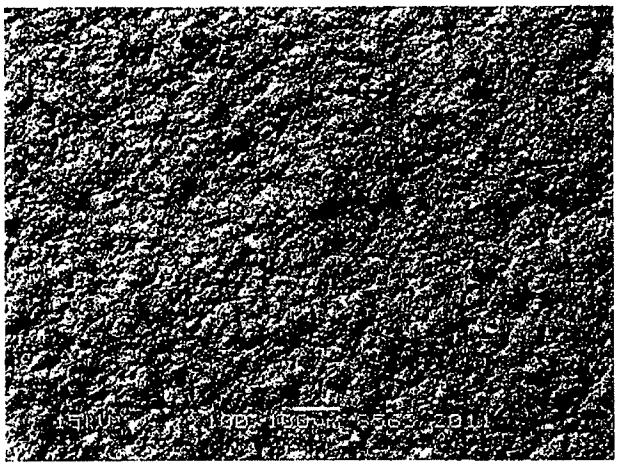
FIG. 5 is a photograph of $YF_3$ spray coating formed by applying the method according to the invention, wherein (a) is a photograph of a coating surface and (b) is a photograph of a coating section.
Figure 5:
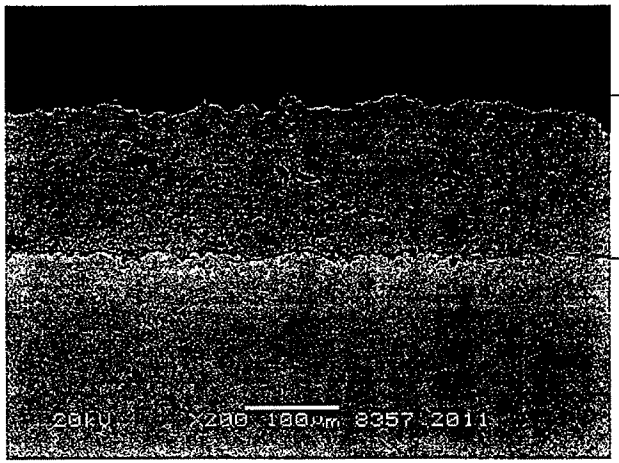

Next, FIG. 5 is SEM images of a surface and a section of $YF_3$ spray coating formed on the substrate surface by the above method according to the invention. From these images, it is understood that a relatively dense spray coating is adhered and formed onto the substrate surface at a good state.

(c) Features of Fluoride Spray Coating

As physicochemical properties of the fluoride itself can be pointed out the followings. That is, the fluoride coating has a chemical stability to a halogen-based gas as compared with a metal coating or a ceramic coating, but is weak in the mutual bonding force of fluoride particles constituting the coating and the adhesion strength to the substrate because the surface energy is small. Also, since a large residual stress is liable to be generated in the coating formation, even if the substrate is slightly deformed after the coating formation, peeling off of the coating occurs easily and frequently. In addition, since the fluoride is poor in the ductility, the coating is "cracked" easily and causes corrosion of the substrate due to internal penetration of an acid or alkali cleaning liquid together with porous portions produced in the above coating formation. Therefore, the fluoride is good in the corrosion resistance but has a problem that the property cannot be utilized as a corrosion resistant coating.

In this regard, according to the invention, the fluoride particles constituting the spray coating form an implantation structure by colliding onto the substrate or the substrate surface existing the carbide cermet formed thereon with a large kinetic energy, so that the mutual bonding force therebetween is improved, and particularly when the undercoat layer or the particle dotted parts of carbide cermet is formed on the substrate surface, the adhesion of the coating is also improved, whereby the above problems of the fluoride can be solved. That is, the effect of preventing the corrosion of the substrate by the prevention from the peeling or cracking of the coating and the prevention from penetration of the cleaning fluid accompanied therewith.

Moreover, the fluoride spray coating formed according to the invention can be used as is in a coating-forming state, but is subjected to a heat treatment at 250° C.-500° C. after the coating formation, if necessary, whereby the residual stress can be released easily or an amorphous phase can be easily crystallized (orthorhombic crystal phase). In the invention, therefore, the use of these treatments is not particularly limited. The reason why the temperature of the heat treatment is limited to the above range is due to the fact that when it is lower than 250° C., a long time is taken for releasing the residual stress of the coating and the crystallization is also insufficient, while when it exceeds 500° C., there is a possibility for promoting a physicochemical change of the fluoride spray coating.

EXAMPLES

Example 1

In this example are examined a temperature of a working gas for coating formation and formation or no formation of a fluoride spray coating by using $YF_3$ and $AlF_3$ as a fluoride.

(1) Substrate: As a substrate is used SUS304 steel (size: 30 mm×30 mm×thickness 5 mm). After the surface of the substrate is subjected to a blast roughening treatment, WC-12Co is sprayed by a high-velocity flame spraying method under conditions that a spraying (flying) rate is 630 m/sec and the spraying number is 8 times to form an undercoat layer having a thickness of 100 μm, which is preheated at 180° C. and then used under test.

(2) Spraying atmosphere: In the spraying method of the invention example, an inert gas of Ar, $N_2$ or He is used as a working gas for coating formation and the temperature of each gas is set to 1300° C. The presence or absence and the quality of the fluoride coating formed on the substrate surface are checked while maintaining a flying velocity of fluoride particles flying in such a spraying atmosphere within a range of 600-660 m/sec.

(3) Fluoride material for coating formation: As the fluoride are used $YF_3$ and $AlF_3$ each having a particle size of 10-35 μm. As a spraying method according to a comparative example are used conventional atmospheric plasma spraying method and reduced-pressure plasma spraying method in which Ar and hydrogen gases are used as a plasma working gas (particle flying velocity: from 350 to 500 m/sec), whereby coatings of $YF_3$ and $AlF_3$ are formed with the respective plasma jet as a heat source.

(4) Test results:

The test results are shown in Table 1. As seen from the results of this table, in the spraying method proposed by the invention, the formation of the fluoride coating is not found if the temperature of the working gas for coating formation (Ar, $N_2$, He) is lower than 500° C. (even if the adhesion of the fluoride particles is recognized, the coating is porous and does not come into practical use), but when the gas temperature is made to not lower than 600° C., the formation of coatings having good appearance could be first confirmed.

On the other hand, in the conventional atmospheric plasma spraying method and reduced-pressure plasma spraying method, the formation of $YF_3$ coating is found, but $AlF_3$ coating has many defects (porous and poor in the uniformity) and a practical coating nature is not obtained. This cause is due to the fact that since $AlF_3$ is very high in the vapor pressure, $AlF_3$ particles are vaporized or decomposed from their surfaces when they fly in the high-temperature plasma jet.

TABLE 1

| | | | | Temperature of working gas (° C.) | | | | | |
|---|---|---|---|---|---|---|---|---|---|
| No. | Substrate | Working gas | Coating material | Less than 500 | 600~750 | 800~1000 | 1100~1300 | Not less than 4000 | Remarks |
| 1 | SUS304 | Ar | $YF_3$ | x | ○ | ○ | ○ | — | Invention |
| 2 | steel | | $AlF_3$ | x | ○ | ○ | ○ | — | example |
| 3 | | $N_2$ | $YF_3$ | x | ○ | ○ | ○ | — | |
| 4 | | | $AlF_3$ | x | ○ | ○ | ○ | — | |
| 5 | | He | $YF_3$ | x | ○ | ○ | ○ | — | |

TABLE 1-continued

| No. | Substrate | Working gas | Coating material | Temperature of working gas (° C.) Less than 500 | 600~750 | 800~1000 | 1100~1300 | Not less than 4000 | Remarks |
|---|---|---|---|---|---|---|---|---|---|
| 6 | | | $AlF_3$ | x | ○ | ○ | ○ | — | |
| 7 | | $Ar/H_2$ | $YF_3$ | — | — | — | — | ○ | Comparative |
| 8 | | (APS) | $AlF_3$ | — | — | — | — | x | example |
| 9 | | $Ar/H_2$ | $YF_3$ | — | — | — | — | ○ | |
| 10 | | (VPS) | $AlF_3$ | — | — | — | — | x | |

(1) The velocity of fluoride particles flying in the working gas of Nos. 1-6 is 600-660 m/sec (measured by a laser velocity meter).

(2) After the substrate surface is subjected to a blast treatment [Ra: 0.25-0.40 μm, Rz: 0.5-0.92 μm], an undercoat layer of WC—12Co is formed thereon at a thickness of 100 μm.

(3) The preheating temperature of the substrate is 180° C.

(4) Symbols of evaluation x: no formation of coating ○: formation of coating —: indicates a temperature at which reproduction cannot be performed in the inert gas and plasma jet.

Example 2

In this example are examined influences of a coating formation method and a pretreatment for the substrate upon the porosity of the fluoride spray coating formed on a surface of SS400 steel.

(1) Substrate: As a substrate is used SS400 steel (size: 50 mm×50 mm×thickness: 3.2 mm). There are provided two kinds of samples, one of which is a substrate only subjected to an existing blast roughening treatment with alumina particles and the other sample is a substrate formed with an undercoat layer of WC-12Co at a thickness of 80 μm by the same method as in Example 1.

(2) Spraying atmosphere: In the invention example, Ar gas heated to 750° C. is used as a working gas for coating formation, and a flying velocity of $YF_3$ particles flying in such a spraying atmosphere is set to a range of 650-700 m/sec.

(3) Fluoride material for coating formation: $YF_3$ (particle size: 10-40 μm) is used and a coating having a thickness of 120 μm is formed by the method according to the invention, the same conventional atmospheric plasma spraying method as in Example 1 and a high-velocity flame spraying method as a comparative example.

(4) Ferroxyl test (porosity)

As a ferroxyl test method is used the following method specifically. That is, 10 g of potassium hexacyanoferrate (III) and 15 g of sodium chloride are dissolved in 1 litter of distilled water and impregnated in a filter paper for analysis sufficiently. Thereafter, the filter paper is adhered to a surface of the test sample and left to stand for 30 minutes, and then the filter paper is peeled-off to visually judge the presence or absence of blue spots on the surface of the filter paper. This can be judged in such a manner that when through-holes are existent in the amorphous coating, the ferroxyl test liquid is penetrated into the holes and reached to a boundary to iron substrate to produce iron ions and potassium hexacyanoferrate (III) is reacted with the iron ion to form blue spots on the surface of the filter paper.

(5) Test results

The test results are shown in Table 2. As seen from the results of this table, blue spots are generated from all the fluoride spray coatings tested, from which it is proved that through-holes are existent in the coating. However, when the number of blue spots is examined, 3-7 large blue spots are observed in the coatings (Nos. 3 and 4) formed by the atmospheric plasma spraying method or the high-velocity flame spraying method as a comparative example, whereas the number of spots is small in the coatings formed by the spraying method adapted to the invention, which indicates a tendency of densification as compared with the former case. Furthermore, it has been found that the number of through-holes is small even in the coating formed on the substrate surface after the spraying of WC—Co particles and such a spraying can be practically used as a pretreatment for forming the fluoride coating.

TABLE 2

| No. | Substrate | Coating method | Treatment of substrate surface undercoat | Coating material | Number of blue spot by ferroxyl test | Remarks |
|---|---|---|---|---|---|---|
| 1 | SS400 steel | Method of invention | WC—Co Undercoat layer | $YF_3$ | 1~2 | Invention example |
| 2 | | (Example 1) | Blast roughening | $YF_3$ | 1~2 | |
| 3 | | Atmospheric plasma spraying method | Blast roughening | $YF_3$ | 4~5 | Comparative example |
| 4 | | High-velocity flame spraying method | | $YF_3$ | 3~7 | |

(Remarks)

(1) Thickness of undercoat layer of WC—12Co: 80 μm (2) Thickness of coating to be tested: 120 μm (fluoride)

(3) Roughness of substrate subjected to blast roughening: Ra 0.6-0.69 μm, Rz 1.2-1.8 μm.

(4) Ferroxyl test: according to a test method of ceramic spray coating in JIS H8666.

Example 3

In this example, a flying velocity of fluoride particles and a preheating temperature of a substrate are varied to determine a flying velocity and a preheating temperature required for forming the fluoride coating, respectively.

(1) Substrate: The same stainless steel as in Example 1 is used. A sample is prepared by subjecting the substrate to a blast roughening treatment, forming an undercoat layer of WC-8Co-5Cr at a thickness of 120 μm under the same conditions as in Example 1 and then preheating at a temperature range of 20° C.-520° C.

(2) Ar gas heated to 750° C. is used as a working gas for coating formation, and the coating formation is performed under 3 conditions that a velocity of fluoride particles flying in such a spraying atmosphere is set to 500 m/sec, 600-700 m/sec and 750 m/sec, respectively.

(3) Fluoride for coating formation: $YF_3$ (particle size: 10-35 μm)

(4) Test results

The test results are shown in Table 3. As seen from the results of this table, when the flying velocity of $YF_3$ particles is less than 500 m/sec, sufficient coating formation is not performed even if the preheating temperature of the substrate is varied within a range of 20° C.-520° C. (No. 1). However, when the flying velocity of the fluoride spraying particles is made to not less than 600 m/sec, coating formation is attained if the preheating temperature of the substrate is maintained at not lower than 80° C., This tendency is not substantially changed when the flying velocity is made to not less than 750 m/sec, and the formation of the good spray coating is recognized. From this, it is proved that predetermined effects are obtained when the flying velocity of the fluoride spraying particles required for forming the fluoride coating is not less than 600 m/sec and the preheating temperature of the substrate (SUS304 steel) is 80° C.-500° C.

Moreover, the maximum preheating temperature of the substrate is varied depending upon the material of the substrate and is preferable to be controlled to a lower temperature because a non-ferrous metal such as Al, Ti or the like is subjected to a deformation or a metallurgical change with the increase of the temperature to generate a change such as formation of oxide scale on a surface of an iron steel material. In this regard, a sintered body such as carbide, oxide or the like is not almost affected by the heating temperature, so that good spray coatings are formed as long as the temperature is made higher in view of the production, and hence the maximum temperature is set to 700° C.

Example 4

In this example are examined a flying velocity of fluoride particles, a roughening condition of a substrate surface and a state of a coating formed on a surface of an undercoat layer of carbide cermet.

(1) Substrate: The same test sample of SUS304 stainless steel as in Example 1 is used. There are provided a sample subjected at its surface to a blast roughening treatment and a sample formed with an undercoat layer of WC-18Co by the same method as in Example 1. Moreover, both of the substrates are preheated to 200° C.

(2) Spraying atmosphere: Ar gas heated to 700° C. is used as a working gas for coating formation and a flying velocity of fluoride particles flying in such a spraying atmosphere is adjusted to not less than 500 m/sec but not more than 750 m/sec.

(3) Fluoride for coating formation: $YF_3$ (particle size: 5-30 μm)

(4) Test results

The test results are shown in Table 4. As seen from the results of this table, when the flying velocity of the fluoride particles is less than 500 m/sec, the formation of fluoride coating is not sufficient even if the undercoat layer of carbide cermet is formed on the substrate surface, and even if the coating is formed, it is porous and non-uniform. When the velocity of the particles is made to not less than 600 m/sec, good coating is formed in both of a blast roughened sample (No. 2) and a sample sprayed with WC—Co particles, and particularly the coating on the sample sprayed with WC—Co particles indicates an excellent appearance (No. 3).

TABLE 3

| No. | Substrate | Flying velocity of particle (m/S) | Pre-heating temperature of substrate (° C.) 20 (Room temperature) | 55~65 | 80~90 | 150~170 | 300~350 | Not less than 500 | Remarks |
|---|---|---|---|---|---|---|---|---|---|
| 1 | SUS304 steel | Less than 500 | x | x | x | Δ | Δ | Δ | Comparative example |
| 2 | | 600~700 | Δ | Δ | ○ | ○ | ○ | ○ | Invention |
| 3 | | Not less than 750 | Δ | Δ | ○ | ○ | ○ | ○ | example |

(Remarks)

(1) Coating formation is performed by using Ar gas heated to 750° C. as a working gas for coating formation.

(2) As the substrate are used a substrate subjected to a blast treatment (Ra 0.3-0.54 μm, Rz 0.7-0.89 μm) and a substrate formed with an undercoat layer of WC—8Co—5Cr having a thickness of 120 μm.

(3) Symbols of evaluation: x: no formation of coating, Δ: incomplete formation of coating (porous, non-uniform), ○: formation of coating.

TABLE 4

| No. | Substrate | Treatment of substrate surface undercoat | Flying velocity of particle (m/S) Less than 500 | 600~700 | Not less than 750 | Remarks |
|---|---|---|---|---|---|---|
| 1 | SUS304 steel | None | x | x | x | Comparative example |
| 2 | | Blast roughening | x | ○ | ○ | Invention example |
| 3 | | WC—Co—Cr Undercoat layer | Δ | ○ | ○ | |

(Remarks)

(1) Coating is formed on a surface of SUS304 steel sample preheated to 200° C. with $N_2$ gas fluid (700° C.) as a working gas for coating formation.

(2) Surface roughness by a blast roughening treatment: Ra 0.23-0.35 μm, Rz: 0.4-0.9 μm.

(3) Undercoat layer of carbide cermet is formed at a thickness of 120 μm by the same method as in Example 1.

(4) Symbols of evaluation x: no formation of Coating Δ: incomplete formation of Coating (porous, non-uniform and so on) ○: formation of Coating.

Example 5

In this example, a fluoride spray coating is formed on a surface of Al alloy substrate (size: width 30 mm×length 50 mm×thickness 3 mm) by the method adapted to the invention to evaluate a resistance to plasma etching of the coating.

(1) Substrate: After a surface of Al alloy (A3003 defined by JIS H4000) to a blast roughening treatment, an undercoat layer of $Cr_3C_2$-18Ni-8Cr is formed at a thickness of 150 μm by the same method as in Example 1 and then preheated to 200° C.

(2) Spraying atmosphere: He gas heated to 800° C. is used as a working gas for coating formation and a flying velocity of fluoride particles flying in such a spraying atmosphere is controlled to 650-700 m/sec.

(3) Fluoride for coating formation: $YF_3$, $DyF_3$ and $CeF_3$ (particle size: 5-45 μm) are sprayed to form a coating of 180 μm in thickness, respectively. As a coating for a comparative example is formed a coating at a thickness of 180 μm by an atmospheric plasma spraying method of $Y_2O_3$, $Dy_2O_3$ and $CeO_2$, respectively, which is evaluated under the same conditions.

(4) Gas composition of plasma etching atmosphere and plasma output (i) Atmospheric gas and flow rate thereof (a) F-containing gas: $CHF_3/O_2/Ar$=80/100/160 (flow rate $cm^3$ per 1 minute)

(b) CH-containing gas: $C_2H_2/Ar$=80/100 (flow rate $cm^3$ per 1 minute)

(ii) Plasma irradiation output

High-frequency power: 1300 W

Pressure: 4 Pa

Temperature: 60° C.

(iii) Atmosphere of plasma etching test (a) Performed in an F-containing gas atmosphere (b) Performed in a CH-containing gas atmosphere (c) Performed in an alternately repeated atmosphere of F-containing gas atmosphere for 1 hour↔ CH-containing gas atmosphere for 1 hour (5) Evaluation method In the evaluation of the test for plasma erosion resistance, the plasma erosion resistance and environmental pollution resistance are investigated by measuring the number of particles of coating ingredients flied from the coating to be tested by etching. The number of particles is evaluated by measuring a time till the number of particles having a particle size of not less than 0.2 μm adhered to a surface of a silicon wafer having a diameter of 8 inch disposed in a test container reaches to 30.

(6) Test results

The test results are shown in Table 5. As seen from the results, the oxide based coatings (No. 1, 3, 5) of the comparative examples indicate a such a situation that the generation of particles is smallest in the CH-containing gas and becomes somewhat large in the F-containing gas and the time reaching to an acceptable value becomes short. However, it is proved that the number of particles generated becomes further large in the alternately repeated atmosphere of F-containing gas and CH-containing gas. This cause is considered due to the fact that the oxide film in the surface of the oxide ceramic coating becomes always unstable and is scattered by a repetition of oxidation action of fluoride gas in the F-containing gas and a reduction action of CH gas. On the other hand, the fluoride coatings (No. 2, 4, 6) maintain a chemically stable state even in the F-containing gas, the CH-containing gas and the alternately repeated atmosphere of these gases, which is considered to suppress the generation of particles. Also, it is assumed that the time of the oxide coating is shorter by about ⅕-1/10 than that of the fluoride coating and the environmental pollution resistance is improved.

TABLE 5

| No. | Coating to be tested | Time till a generation amount of particles exceeds a permissible value: F-containing gas | CH-containing gas | Repeat of F-containing gas and CH-containing gas | Remarks |
|---|---|---|---|---|---|
| 1 | $Y_2O_3$ | 70 | 120 | 35 | Comparative example |
| 2 | $YF_3$ | 110 | 270 | 95 | Invention example |
| 3 | $Dy_2O_3$ | 70 | 120 | 30 | Comparative example |
| 4 | $DyF_3$ | 110 | 280 | 95 | Invention example |

TABLE 5-continued

| No. | Coating to be tested | Time till a generation amount of particles exceeds a permissible value: F-containing gas | CH-containing gas | Repeat of F-containing gas and CH-containing gas | Remarks |
|---|---|---|---|---|---|
| 5 | $CeO_2$ | 80 | 130 | 30 | Comparative example |
| 6 | $CeF_2$ | 115 | 265 | 88 | Invention example |

(Remarks)

(1) Undercoat layer of carbide cermet is $Cr_3C_2$—18Ni—8Cr of 150 μm in thickness under the same conditions as in Example 1.

(2) Thickness of the coating to be tested is 180 μm.

(3) Surface roughness of substrate after blast roughening treatment: Ra 0.4-0.5 μm, Rz 0.7-0.9 μm.

(4) Formation of oxide coating is performed by an atmospheric plasma spraying method.

Example 6

In this example is examined an influence of pretreatment of a substrate surface upon an adhesion of fluoride spray coating.

(1) Kind of Pretreatment

The following pretreatments are performed to one surface of Al 3003 alloy (size: diameter 25 mm×thickness 5 mm) as a substrate.

(i) After degreasing, the surface is polished with a wire brush lightly.

(ii) After degreasing, a coating of Ni-20Cr having a thickness of 50 μm is formed by an atmospheric plasma spraying method (metal undercoat).

(iii) After degreasing, an undercoat layer of WC-12Co having a thickness of 80 μm is formed by a high-velocity flame spraying method (velocity 680 m/sec, spraying number 7 times).

(iv) After degreasing, a blast roughening treatment is performed with $Al_2O_3$ abrasive.

(v) An undercoat layer of carbide cermet having a thickness of 80 μm is formed to the above blast treated surface by an atmospheric plasma spraying method of Ni-20Cr.

(vi) An undercoat layer of carbide cermet having a thickness of 80 μm is formed to the above blast treated surface by a high-velocity flame spraying method of WC-12Co.

The above steps (i), (ii), (iv) and (v) are comparative examples, and the other steps (iii) and (vi) are examples according to the invention.

(2) Formation of Fluoride Spray Coating

A fluoride spray coating having a coating thickness of 160 μm is formed to the above substrate surface by using He gas heated to 800° C. and $YF_3$ particles flying in such a gas at a flying velocity of fluoride particles controlled to a range of 680-750 m/sec.

(3) Test Method of Adhesion

The adhesion of the spray coating is measured by a test method of adhesion strength defined in Test method of ceramic spray coating of JIS H8666.

(4) Test Results

The test results are shown in Table 6. As seen from the results of this table, the fluoride spray coating (No. 1), which is formed on the surface of the substrate lightly wire-brushed after degreasing, is poor in the adhesion force and causes the peeling of the coating at 0.5-1.2 MPa. Also, the fluoride spray coating (No. 2) provided with the metal undercoat indicates a little improvement of adhesion force, but its effect is small. On the contrary, the fluoride spray coating (No. 3) provided with the undercoat layer of WC-12Co exhibits a high adhesion force of 12-17 MPa. On the other hand, the adhesion force of the fluoride spray coating (No. 4) formed on the blast roughened surface indicates a higher adhesion force than that of the wire-brushed surface. This tendency is recognized in the fluoride spray coating (No. 5) after the formation of the metal undercoat. This tendency becomes higher as compared with the cases of No. 1 and No. 2, from which the roughening of the substrate and the formation of the metal undercoat bring about a certain effect of improving the adhesion of the coating. On the contrary, the coating (No. 6) formed with the undercoat layer of WC-12Co as an adaptable example of the invention indicates a maximum adhesion force among the tested coatings. Moreover, since the undercoat layer of carbide cermet indicates a high adhesion force regardless of the presence or absence of the blast roughening treatment to the substrate surface, a possibility for omitting the roughening treatment can be expected.

TABLE 6

| No. | Substrate | Pretreatment | Construction of coating: Undercoat | Topcoat | Adhesion MPa | Remarks |
|---|---|---|---|---|---|---|
| 1 | Al3003 (Al alloy) | Decreasing only (wire brushing) | None | $YF_3$ | 0.5~1.2 | Comparative example |
| 2 | | | Ni—Cr (50 m) | | 4~5 | Comparative example |
| 3 | | | WC—12Co (80 μm) | | 12~17 | Invention example |
| 4 | | Blast roughening treatment | None | | 4~6 | Comparative example |
| 5 | | | Ni—Cr (80 μm) | | 7~8 | Comparative example |

TABLE 6-continued

| No. | Substrate | Pretreatment | Construction of coating Undercoat | Topcoat | Adhesion MPa | Remarks |
|---|---|---|---|---|---|---|
| 6 | | | WC—12Co (80 μm) | | 13~17 | Invention example |

(Remarks)
(1) Three samples are tested per one condition, and the adhesion force of the coating is indicated by minimum value to maximum value.
(2) The adhesion strength of the coating is measured by a test method of adhesion strength defined in Test method of ceramic spray coating of JIS H8666.

Example 7

In this example is examined influences of a coating formation method and a roughening treatment of substrate upon a porosity of a fluoride spray coating formed on a surface of a stainless steel (SS400).

(1) Substrate: As a substrate is used SS400 steel (size: width 50 mm×length 50 mm×thickness 3.2 mm). There are provided two samples, one of which is a sample obtained by subjecting to only a usual blast roughening treatment with alumina particles (comparative example) and the other is a sample formed by spraying WC—Co particles at a flying velocity of 720 m/sec and a spraying number of 6 times by a high-velocity flame spraying method according to the invention to form spray particle dotted parts at an area ratio: 30-32%.

(2) Spraying atmosphere: Ar gas heated to 750° C. is used as a working gas for coating formation and a flying velocity of $YF_3$ particles flying in such a gas is controlled to a range of 650-700 m/sec.

(3) Fluoride for coating formation: $YF_3$ (particle size: 10-40 μm) is used and a coating having a thickness of 120 μm is formed by the method adapted to the invention, and coatings of comparative examples are formed by the conventional atmospheric plasma spraying method and high-velocity flame spraying method.

(4) Ferroxyl test (porosity)

As a ferroxyl test method is concretely used the following method.

That is, 10 g of potassium hexacyanoferrate (III) and 15 g of sodium chloride are dissolved in 1 litter of distilled water, which is sufficiently impregnated in a filter paper. Thereafter, the filter paper is applied to a surface of a sample and left to stand for 30 minutes, and then the filter paper is peeled off to visually judge the presence or absence of blue spots on the filter paper surface. This can be judged in such a manner that when through-holes are existent in the amorphous coating, the ferroxyl test liquid is penetrated into the holes and reached to a boundary to iron substrate to produce iron ions and potassium hexacyanoferrate (III) is reacted with the iron ion to form blue spots on the surface of the filter paper.

(5) Test results

The test results are shown in Table 7. As seen from the results of this table, blue spots are generated in all of the fluoride spray coatings tested, from which it is proved that through-holes are existent in the coating. However, when the number of blue spots is examined, 3-7 large blue spots are observed in the coatings (Nos. 3 and 4) formed by the atmospheric plasma spraying method or the high-velocity flame spraying method as a comparative example, whereas the number of spots is small in the coatings 1 (coating having spray particle dotted parts at an area ratio of 32%) and 2 (area ratio of 30%) formed by the spraying method adapted to the invention, which indicates a tendency of densification as compared with the comparative examples. Furthermore, it has been found that the number of through-holes is small even in the coating formed on the substrate surface after the spraying of WC—Co particles and such a spraying can be practically used as a pretreatment for forming the fluoride coating.

TABLE 7

| No. | Substrate | Coating-formation method | Treatment of substrate surface | Coating material | Number of blue spot by ferroxyl test | Remarks |
|---|---|---|---|---|---|---|
| 1 | SS400 steel | Formation of WC—Co particle dotted part | Area ratio (32%) | $YF_3$ | 1~2 | Invention example |
| 2 | | | Area ratio (30%) | $YF_3$ | 1~2 | |
| 3 | | Atmospheric plasma spraying method | Blast roughening | $YF_3$ | 4~5 | Comparative example |
| 4 | | High-velocity flame spraying method | | $YF_3$ | 3~7 | |

(Remarks)
(1) Thickness of coating to be tested: 120 μm
(2) Roughness of substrate after blast roughening treatment: Ra 0.6-0.69 μm, Rz 1.2-1.8 μm
(3) Ferroxyl test: according to Test method of ceramic spray coating in JIS H8666.

Example 8

In this example, a flying velocity and a preheating temperature required for forming a fluoride coating are determined by changing a flying velocity of fluoride particles and a preheating temperature of a substrate, respectively.

(1) Substrate: The same stainless steel as in Example 7 is used, which is subjected to a blast roughening treatment and preheated at a temperature range of 20° C.-520° C. to provide a sample.

(2) Spraying atmosphere: Ar gas heated to 750° C. is used as a working gas for coating formation and a coating is formed under 3 conditions that a velocity of fluoride particles flying in such a gas is less than 500 m/sec, 600-700 m/sec and 750 m/sec.

(3) Fluoride for coating formation: $YF_3$ (particle size: 10-35 μm)

(4) Test results

The test results are shown in Table 8. As seen from the results of this table, when the flying velocity of $YF_3$ particles is less than 500 m/sec, sufficient coating formation is not attained even if the preheating temperature of the substrate is varied between 20° C. and 520° C. (No. 1). However, when the flying velocity of the particles is made to not less than 600 m/sec, the coating formation is attained as the preheating temperature of the substrate is maintained at not lower than 80° C. This tendency is not substantially changed when the flying velocity is made to not less than 750 m/sec, and the formation of the spray coating is recognized at a good state. From this, it is proved that predetermined effects are obtained when the flying velocity of the fluoride particles required for forming the fluoride coating is not less than 600 m/sec and the preheating temperature of the substrate (SUS304 steel) is 80° C.-500° C.

Moreover, the maximum preheating temperature of the substrate is varied depending upon the material of the substrate and is preferable to be controlled to a lower temperature because a non-ferrous metal such as Al, Ti or the like is subjected to a deformation or a metallurgical change with the increase of the temperature to generate a change such as formation of oxide scale on a surface of an iron steel material. In this regard, a sintered body such as carbide, oxide or the like is not almost affected by the heating temperature, so that good spray coatings are formed as long as the temperature is made higher in view of the production, and hence the maximum temperature is set to 700° C.

TABLE 8

| No. | Substrate | Flying velocity of particle (m/sec.) | Preheating treatment of substrate (° C.) 20 (room temperature) | 55~65 | 80~90 | 150~170 | 300~350 | Not less than 500 | Remarks |
|---|---|---|---|---|---|---|---|---|---|
| 1 | SUS304 steel | Less than 500 | x | x | x | Δ | Δ | Δ | Comparative example |
| 2 | | 600~700 | Δ | Δ | ○ | ○ | ○ | ○ | Invention |
| 3 | | Not less than 750 | Δ | Δ | ○ | ○ | ○ | ○ | Example |

(Remarks)

(1) Coating formation is performed by using Ar gas heated to 750° C. as a working gas for coating formation.

(2) Substrate surface subjected to a blast treatment: Ra 0.3-0.54 μm, Rz 0.7-0.89 μm (3) Symbols of evaluation: x: no formation of coating, Δ: incomplete formation of coating (porous, non-uniform), ○: formation of coating.

Example 9

In this example is examined a state of forming a coating in accordance with a difference on a flying velocity of fluoride particles and a roughened state of a substrate surface.

(1) Substrate: The same SUS304 stainless steel as in Example 1 is used. There are provided a sample of subjecting or not subjecting to a blast roughening treatment, and a sample of spraying WC—Co particles by a high-velocity flame spraying method (750 m/sec) under the same conditions as in Example 7 to form spray particle dotted parts at an area ratio of 28%. Moreover, the substrate is preheated to 200° C.

(2) Spraying atmosphere: Ar gas heated to 700° C. is used as a working gas for coating formation, and a flying velocity of fluoride particles flying in such a gas is controlled to a range of 500-750 m/sec.

(3) Fluoride for coating formation: $YF_3$ (particle size: 5-30 μm)

(4) Test results

The test results are shown in Table 9. As seen from the results of this table, when the flying velocity of the fluoride particles is less than 500 m/sec, the formation of fluoride coating is not sufficient even if the substrate surface is roughened, and even if the coating is formed, it is porous and non-uniform. When the velocity of the particles is made to not less than 600 m/sec, good coatings are formed in both of the blast roughened sample (No. 2) and the sample having the spray particle dotted parts formed by spraying WC—Co particles, and particularly the coating having the spray particle dotted parts at an area ratio of 28% formed by spraying WC—Co particles indicates a good appearance (No. 3).

TABLE 9

| No. | Substrate | Treatment of substrate surface | Flying velocity of particle (m/S) Less than 500 | 600~700 | Not less than 750 | Remarks |
|---|---|---|---|---|---|---|
| 1 | SUS304 steel | None | x | x | x | Comparative example |
| 2 | | Blast treatment | x | ○ | ○ | Invention |

TABLE 9-continued

| No. | Substrate | Treatment of substrate surface | Flying velocity of particle (m/S) Less than 500 | 600~700 | Not less than 750 | Remarks |
|---|---|---|---|---|---|---|
| 3 | | WC—Co particle dotted part | Δ | ○ | ○ | example |

(Remarks)

(1) SUS 304 steel sample preheated to 200° C. with $N_2$ gas fluid (700° C.)

(2) Surface roughness by a blast roughening treatment: Ra 0.23-0.35 μm, Rz 0.4-0.9 μm (3) Symbols of evaluation x: no formation of coating Δ: incomplete formation of coating (porous, non-uniform and so on) ○: formation of coating Example 10

In this example is examined a corrosion resistance to a vapor of a halogen based acid in a fluoride spray coating formed by a method adapted to the invention.

(1) Substrate: A substrate of SS 400 steel (size: width 30 mm×length 50 mm×thickness 3.2 mm) is used, and blast-roughened at its surface and preheated to 180° C.

(2) Spraying atmosphere: Ar gas heated to 850° C. is used as a working gas for coating formation, and a flying velocity of fluoride particles flying in such a gas is controlled to a range of 680-720 m/sec.

(3) Fluoride for coating formation: As a fluoride are used $AlF_3$ and $YF_3$ (particle size: 10-60 μm), which are shaped into a coating having a thickness of 250 μm.

(4) Corrosion test (a) As a corrosion test by HCl vapor is adopted a method wherein 100 ml of an aqueous solution of 30% HCl is placed in a bottom portion of a desiccator for chemical experiment and a sample is suspended in a top portion thereof and exposed to HCl vapor generated from the aqueous HCl solution. A temperature of the corrosion test is 30° C.-50° C. and a time thereof is 96 hours.

(b) A corrosion test by HF vapor is conducted by placing 100 ml of an aqueous HF solution in a bottom portion of an autoclave made of SUS 316 and suspending a sample in a top portion thereof. A temperature of the corrosion test is 30° C.-50° C., and an exposing time is 96 hours.

(6) Test results

The test results are shown in Table 10. As seen from the results of this table, a large amount of red rusts reaches to the coating surface in all of the coatings of the comparative examples (Nos. 2, 4). That is, it is considered that since many through-holes are existent in the oxide coating, a vapor of HCl, HF or the like reaches to an interior of the coating via the through-holes to corrode the SS 400 steel substrate and an iron component as a corroded product reaches to the coating surface via the through-holes to present red rust state. On the other hand, the generation of red rust is observed in the fluoride coatings (Nos. 1, 3), but its extent remained to about 30-40% of the comparative example. From this result, it is found that although through-holes are existent in the fluoride coating, they are little as compared with those of the oxide coating, and further since the fluoride coating itself has an excellent corrosion resistance, the good corrosion resistance is developed to vapors of comprehensive halogen based acids.

TABLE 10

| | | | Result of corrosion test | | |
|---|---|---|---|---|---|
| No. | Substrate | Coating material | HCl vapor | HF vapor | Remarks |
| 1 | SS400 | $AlF_3$ | Δ | Δ | Invention example |
| 2 | steel | $Al_2O_3$ | x | x | Comparative example |
| 3 | | $YF_3$ | Δ | Δ | Invention example |
| 4 | | $Y_2O_3$ | x | x | Comparative example |

(Remarks)

(1) Thickness of the coating to be tested is 250 μm.

(2) Substrate subjected to a blast roughening treatment: Ra: 0.48-0.55 μm, Rz: 7.9-8.8 μm.

(3) Symbols of corrosion test results: x: large generation of red rust Δ: small generation of red rust.

Example 11

In this example is examined an influence of pretreatment of a substrate surface upon an adhesion of fluoride spray coating.

(1) Kind of Pretreatment

The following pretreatments are performed to one surface of Al 3003 alloy (size: diameter 25 mm×thickness 5 mm) as a substrate.

(i) After degreasing, the surface is polished with a wire brush lightly.

(ii) After degreasing, a coating of Ni-20 mass % Cr is formed at a thickness of 50 μm by an atmospheric plasma spraying method (undercoat layer of alloy).

(iii) After degreasing, WC-12 mass % Co is blown in a sparse pattern (area ratio: 22%) by an atmospheric plasma spraying method to form spray particle dotted parts.

(iv) After degreasing, a blast roughening treatment is performed with $Al_2O_3$ abrasives.

(v) A coating of Ni-20 mass % Cr is formed at a thickness of 80 μm on the above blast treated surface by an atmospheric plasma spraying method (undercoat layer of alloy).

(vi) WC-12 mass % Co is blown sparsely to the above blast treated surface by a high-velocity flame spraying method (area ratio: 18%).

The above steps (iii) and (vi) are examples according to the invention, and the other steps (i), (ii), (iv) and (v) are comparative examples.

(2) Formation of Fluoride Spray Coating

A fluoride spray coating having a coating thickness of 140 μm is formed to the above pretreated substrate surface by using He gas heated to 800° C. and $YF_3$ particles flying in such a gas at a flying velocity of fluoride particles controlled to a range of 680-750 m/sec.

(3) Test Method of Adhesion

An adhesion of a spray coating is measured by a test method of adhesion strength defined in Test method of ceramic spray coating of JIS H8666.

(4) Test Results

The test results are shown in Table 11. As seen from the results of this table, the fluoride spray coating (No. 1) formed on the lightly wire-brushed surface of the substrate after degreasing is poor in the adhesion force and causes the peeling of the coating at 0.5-1.2 MPa. Also, the fluoride spray coating (No. 2) provided with the metal undercoat indicates a little improvement of adhesion force. On the contrary, the fluoride spray coating (No. 3) formed on the surface having the spray particle dotted parts formed by sparsely blowing WC-12 mass % Co exhibits a high adhesion force of 13-16 MPa. On the other hand, the adhesion force of the fluoride spray coating (No. 4) formed on the blast roughened surface is 4-6 MPa, and also the adhesion force of the fluoride spray coating after the formation of the metal undercoat on the blast roughened surface tends to become higher than those of No. 1 and No. 2. Therefore, the substrate roughening and the formation of the metal undercoat have the effect of improving the adhesion of the coating. On the contrary, the surface having the spray particle dotted parts obtained by sparsely blowing carbide cermet particles according to the invention (No. 6) further improves the adhesion with the fluoride spray coating and exhibits a high adhesion of 13-15 MPa.

TABLE 11

| No. | Substrate | Pretreatment | Construction of coating Undercoat | Topcoat | Adhesion MPa | Remarks |
|---|---|---|---|---|---|---|
| 1 | Al3003 (Al alloy) | Degreasing only (wire brushing) | None | $YF_3$ | 0.5~1.2 | Comparative example |
| 2 | | | Ni—Cr (50 μm) | | 4~5 | Comparative example |
| 3 | | | WC—12Co (Spray particle dotted part) | | 13~16 | Invention example |
| 4 | | Blast roughening treatment | None | | 4~6 | Comparative example |
| 5 | | | Ni—Cr (80 μm) | | 7~8 | Comparative example |
| 6 | | | WC~12Co (Spray particle dotted part) | | 13~15 | Invention example |

(Remarks)
(1) Three samples are tested per one condition, and the adhesion of the coating is represented by minimum value to maximum value.
(2) The adhesion strength of the coating is measured by a test method of adhesion strength defined in Test method of ceramic spray coating of JIS H8666.
(3) The area ratio of spray particle dotted parts is 25% in No. 3 and 27% in No. 6.

INDUSTRIAL APPLICABILITY

As explained above, according to the invention, the fluoride coating is obtained by using an inert gas as a working fluid and spraying at a relatively low temperature and an ultra-high velocity, and the fluoride particles for coating formation does not cause thermal decomposition or phenomenon of removing $F_2$ ingredient, so that the resulting fluoride coating develops physicochemical properties inherent to the fluoride itself. Furthermore, in the forming of the coating, the undercoat layer or spray particle dotted parts are formed so that hard carbide cermet particles are buried into the substrate surface collided at a large kinetic energy, whereby the dense fluoride spray coating having a high adhesion force can be formed. The thus formed fluoride spray coating are excellent in the physicochemical properties such as adhesion, acid resistance, resistance to halogen gas, plasma erosion resistance and the like as compared with the coatings formed by the conventional plasma spraying method or high-velocity flame spraying method and can expect not only the coating for currently used semiconductor working devices but also new applications in the fields requiring more severer and excellent performances as a coating for general petrochemical and chemical plants.

DESCRIPTION OF SYMBOLS

1 working gas source
2 supply device of spraying material
3 heat exchanger for gas heating
4 spraying vessel
5 spray gun
6 nozzle
7 object to be treated
8 silencer
9 main gas pipe
10 sub gas pipe
11 rectifying plate for working gas
12, 13 flow rate control valves

The invention claimed is:

1. A method for forming a fluoride spray coating, comprising:

spraying a fluoride spraying material onto a substrate surface or a pretreated substrate surface at a flying velocity of not less than 500 m/sec in a spraying gas atmosphere maintained at a temperature of 800° C. -1300° C. with a spray gun using an inert gas such as Ar, $N_2$, He or a mixture thereof as a working gas for coating formation to form a fluoride spray coating adhered thereon so as to provide an implantation structure such that at least a part of the fluoride spraying material is adhered so as to bite into concave portions of the substrate surface or an undercoat layer surface of carbide cermet material or into a gap between particles in the spray particle dotted parts of carbide cermet material, or bonded at a state of skewing at its tip portion.

2. The method for forming a fluoride spray coating according to claim 1, wherein a carbide cermet material is spray-blown onto the substrate surface or the pretreated substrate surface at a flying velocity of 150-600 m/sec prior to the spraying of the fluoride to form a film-shaped undercoat layer of carbide cermet material.

3. The method for forming a fluoride spray coating according to claim 1, wherein a carbide cermet material is spray-blown onto the substrate surface or the pretreated substrate surface at a flying velocity of 150-600 m/sec prior to the spraying of the fluoride to form spray particle dotted parts of carbide cermet material adhered at an area ratio of 8-50% and at a state of sparsely sticking as piles.

4. The method for forming a fluoride spray coating according to claim 1, wherein the spray particle dotted parts of the non-film shaped carbide cermet are formed by adhering at least a party of the carbide cermet spraying particles onto the substrate surface sparsely at a state of sticking and foresting piles.

5. The method for forming a fluoride spray coating according to claim 1, wherein the pretreatment comprises at least one of degreasing, descale roughening and preheating.

6. The method for forming a fluoride spray coating according to claim 5, wherein the descale roughening treatment comprises blowing abrasives of $Al_2O_3$ or SiC to the substrate surface to provide a surface roughness to Ra: about 0.05-0.74 μm and Rz: about 0.09-2.0 μm.

7. The method for forming a fluoride spray coating according to claim 1 , wherein the substrate is any of Al and its alloy, Ti and its alloy, carbon-containing iron steel, stainless steels, Ni and its alloy, oxides, nitrides, carbides, silicide and carbon sintered body.

8. The method for forming a fluoride spray coating according to claim 1, wherein the fluoride spray coating is formed by blowing fluoride particles having a particle size of 5 μm to 80 μm, of one or more of materials selected from fluorides of Mg in Group IIa of the Periodic Table, Al in Group IIIb of the Periodic Table, Y in Group IIIa of the Periodic Table, and lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu) as a lanthanoid series metal in Atomic Numbers 57-71 of the Periodic Table, the fluoride particles blown onto the substrate surface at a thickness of 20 μm-500 μm.

9. The method for forming a fluoride spray coating according to claim 1, wherein when the fluoride particles are sprayed by using the inert gas as a working gas for coating formation, a distance between the substrate surface and a nozzle tip of the spray gun is maintained at 5-50 mm.

10. The method for forming a fluoride spray coating according to claim 1, wherein the flying velocity of the fluoride spraying material is not less than 600 m/sec and not more than 800 m/sec.

11. The method for forming a fluoride spray coating according to claim 1, wherein the flying velocity of the fluoride spraying material is not less than 650 m/sec and not more than 1000 m/sec.

12. The method for forming a fluoride spray coating according to claim 2, wherein the undercoat layer of carbide cermet material is a layer having a thickness of 30-200 μm provided by spraying particles of one or more of carbide cermet materials selected from WC—Co, WC—Ni—Cr, WC—Co—Cr and $Cr_3C_2$—Ni—Cr.

13. The method for forming a fluoride spray coating according to claim 3, wherein the spray particle dotted part of carbide cermet material is a portion of sparsely sticking sprayed particles as piles provided by spraying particles of one or more of carbide cermet materials selected from WC—Co, WC—Ni—Cr, WC—Co—Cr and $Cr_3C_2$—Ni—Cr.

14. A fluoride spray coating covered member comprising a substrate and a fluoride spray coating formed on a surface the substrate, wherein the fluoride spray coating has an implantation structure such that at least a part of a fluoride spraying particle bites into the substrate surface directly or bites into a surface of an undercoat layer of carbide cermet material or a spray particle dotted part of carbide cermet material provided on the substrate surface of the substrate.

15. The fluoride spray coating covered member according to claim 14, wherein a film-shaped undercoat layer of carbide cermet material provided by spraying carbide cermet spraying particles made of WC—Co, WC—Ni—Cr, WC—Co—Cr or $Cr_3C_2$—Ni—Cr is present between the substrate and the fluoride spray coating.

16. The fluoride spray coating covered member according to claim 14, wherein a non-film shaped spray particle dotted part of carbide cermet particles of WC—Co, WC—Ni—Cr, WC—Co—Cr or $Cr_3C_2$—Ni—Cr, and adhered at an area ratio of 8-50% is present between the substrate and the fluoride spray coating such that at least a part of the carbide cermet spraying particles bites into the substrate surface and sparsely stuck and forested as piles and the other remaining particles adhere onto the substrate surface or are embedded into the substrate.

17. The fluoride spray coating covered member according to claim 14, wherein the fluoride spray coating has a thickness of 20-500 μm.

18. The fluoride spray coating covered member according to claim 14, wherein the substrate is subjected to a pretreatment comprising at least one of degreasing, descale roughening and preheating.

19. The fluoride spray coating covered member according to claim 18, wherein the descale roughening treatment comprises blowing abrasives of $Al_2O_3$ or SiC to the substrate surface to provide a surface roughness to Ra: about 0.05-0.74 μm and Rz: about 0.09-2.0 μm.

20. The fluoride spray coating covered member according to claim 14, wherein the substrate is any of Al and its alloy, Ti and its alloy, carbon-containing iron steel, stainless steels, Ni and its alloy, oxides, nitrides, carbides, silicide and carbon sintered body.

21. The fluoride spray coating covered member according to claim 14, wherein the fluoride spray coating is a coating formed by blowing fluoride particles having a particle size of 5 μm to 80 μm, of one or more materials selected from fluorides of Mg in Group IIa of the Periodic Table, Al in Group IIIb of the Periodic Table, Y in Group IIIa of the Periodic Table, and lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu) as a lanthanoid series metal in Atomic Numbers 57-71 of the Periodic Table, the fluoride particles blown onto the substrate surface at a thickness of 20 μm-500 μm.

* * * * *